US011505379B2

(12) United States Patent
Jagannath et al.

(10) Patent No.: US 11,505,379 B2
(45) Date of Patent: Nov. 22, 2022

(54) CONSUMER PRODUCT COMPRISING A FLAT PACKAGE CONTAINING UNIT DOSE ARTICLES

(71) Applicant: The Procter & Gamble Company, Cincinnati, OH (US)

(72) Inventors: Girish Jagannath, Mason, OH (US); Grace Catherine Cook, Cincinnati, OH (US); Mark Robert Sivik, Mason, OH (US); Sun-Jan Alan Huang, Cincinnati, OH (US); Reginald Edward Crutcher, II, Cincinnati, OH (US); Frank William Denome, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 115 days.

(21) Appl. No.: 16/286,672

(22) Filed: Feb. 27, 2019

(65) Prior Publication Data

US 2019/0263575 A1 Aug. 29, 2019

Related U.S. Application Data

(60) Provisional application No. 62/635,795, filed on Feb. 27, 2018.

(51) Int. Cl.

| | |
|---|---|
| ***C11D 17/04*** | (2006.01) |
| ***B65D 65/46*** | (2006.01) |
| ***B65D 27/00*** | (2006.01) |
| ***B65D 75/42*** | (2006.01) |
| ***B65D 75/32*** | (2006.01) |
| *C11D 1/22* | (2006.01) |
| *B65D 85/808* | (2006.01) |

(52) U.S. Cl.

CPC ..... *B65D 65/46* (2013.01); *B65D 27/00* (2013.01); *B65D 75/32* (2013.01); *B65D 75/42* (2013.01); *B65D 85/8085* (2013.01); *C11D 1/22* (2013.01); *C11D 17/042* (2013.01)

(58) Field of Classification Search

None

See application file for complete search history.

(56) References Cited

U.S. PATENT DOCUMENTS

| | | | |
|---|---|---|---|
| 3,859,125 | A | 1/1975 | Miller et al. |
| 4,180,558 | A | 12/1979 | Goldberg et al. |
| 4,286,016 | A | 8/1981 | Dimond et al. |

(Continued)

FOREIGN PATENT DOCUMENTS

| | | | |
|---|---|---|---|
| AU | 2004/202461 | B2 | 11/2007 |
| CA | 2695068 | A1 | 9/2010 |

(Continued)

OTHER PUBLICATIONS

PCT Search Report for appl. No. PCT/US2018/015354, dated May 14, 2018, 13 pages.

(Continued)

*Primary Examiner* — Lorna M Douyon

(57) ABSTRACT

The present disclosure relates to a container system comprising a flat package, which has walls that define an interior space, and at least one fibrous water-soluble unit dose article in the interior space, where the fibrous water-soluble unit dose article comprises household care active agents.

16 Claims, 11 Drawing Sheets

(56) References Cited

U.S. PATENT DOCUMENTS 4,287,219 A 9/1981 Fabre
4,315,965 A 2/1982 Mason et al.
4,342,813 A 8/1982 Erickson
4,349,531 A 9/1982 Mlodozeniec et al.
4,377,615 A 3/1983 Suzuki et al.
4,397,391 A 8/1983 Cornelissens
4,415,617 A 11/1983 D'Elia
4,639,390 A 1/1987 Shoji
4,892,758 A 1/1990 Serbiak et al.
4,923,660 A 5/1990 Willenberg et al.
5,041,252 A 8/1991 Fujii et al.
5,110,678 A 5/1992 Narukawa et al.
5,120,888 A 6/1992 Nohr et al.
5,135,804 A 8/1992 Harpell et al.
5,158,810 A 10/1992 Oishi et al.
5,208,104 A 5/1993 Ueda et al.
5,230,853 A 7/1993 Colegrove et al.
5,246,603 A 9/1993 Tsaur
5,342,335 A 8/1994 Rhim
5,362,532 A 11/1994 Famili et al.
5,364,627 A 11/1994 Song
5,387,147 A 2/1995 Ohshima et al.
5,429,874 A 7/1995 Vanputte
5,455,114 A 10/1995 Ohmory et al.
5,470,424 A 11/1995 Isaac et al.
5,470,653 A 11/1995 Honeycutt et al.
5,486,418 A 1/1996 Ohmory et al.
5,518,730 A 5/1996 Fuisz
5,520,924 A 5/1996 Chapman et al.
5,538,735 A 7/1996 Ahn
5,544,473 A * 8/1996 Maida ..... B65D 81/03 229/928
3,293,718 A 12/1996 Thomas
5,585,059 A 12/1996 Kobayashi et al.
5,651,987 A 7/1997 Fuisz
5,691,015 A 11/1997 Tsukamoto et al.
5,705,183 A 1/1998 Phillips et al.
5,716,692 A 2/1998 Warner et al.
5,717,026 A 2/1998 Ikimine et al.
5,735,812 A 4/1998 Hardy
5,780,418 A 7/1998 Niinaka et al.
5,827,586 A 10/1998 Yamashita et al.
5,840,423 A 11/1998 Sano et al.
5,863,887 A 1/1999 Gillette
5,879,493 A 3/1999 Johnson et al.
5,911,224 A 6/1999 Berger
5,914,124 A 6/1999 Mahoney et al.
5,942,179 A 8/1999 Tallentire et al.
6,008,181 A 12/1999 Cripe
6,037,319 A 3/2000 Dickler et al.
6,066,396 A 5/2000 Inada et al.
6,080,346 A 6/2000 Jack
6,130,193 A 10/2000 Gillette
6,175,054 B1 1/2001 Jacques
6,197,238 B1 3/2001 Wang et al.
6,207,274 B1 3/2001 Ferenc et al.
6,274,162 B1 8/2001 Steffenino et al.
6,319,510 B1 11/2001 Yates
6,406,797 B1 6/2002 Vanputte
6,420,625 B1 7/2002 Jones et al.
6,448,462 B2 9/2002 Groitzsch et al.
6,465,407 B2 10/2002 Hayashi et al.
6,552,123 B1 4/2003 Katayama et al.
6,576,575 B1 6/2003 Griesbach, III et al.
6,608,121 B2 8/2003 Isozaki et al.
6,657,004 B2 12/2003 Mizutani
6,699,826 B1 3/2004 Saijo et al.
6,730,648 B2 5/2004 Gorlin et al.
6,783,852 B2 8/2004 Inada et al.
6,787,512 B1 9/2004 Verrall et al.
6,808,598 B1 10/2004 Takeuchi et al.
6,818,606 B1 11/2004 Hanada et al.
6,898,921 B2 5/2005 Duffield
6,949,498 B2 9/2005 Murphy et al.
6,956,070 B2 10/2005 Fujiwara et al.
6,977,116 B2 12/2005 Cabell et al.
7,026,049 B2 4/2006 Endo et al.
7,041,628 B2 5/2006 Sunder
7,067,575 B2 6/2006 Kitamura et al.
7,083,047 B2 8/2006 Bone et al.
7,094,744 B1 8/2006 Kobayashi et al.
7,115,551 B2 10/2006 Hasenorhrl et al.
7,169,740 B2 1/2007 Sommerville-Roberts et al.
7,196,026 B2 3/2007 Di Luccio et al.
RE39,557 E 4/2007 Moe
7,226,899 B2 6/2007 Cole et al.
7,285,520 B2 10/2007 Krzysik et al.
7,387,787 B2 6/2008 Fox
7,407,669 B2 8/2008 Leung et al.
7,429,273 B2 9/2008 DeDominicis et al.
7,446,084 B2 11/2008 Barthel et al.
7,491,407 B2 2/2009 Pourdeyhimi et al.
7,507,698 B2 3/2009 Franzolin et al.
7,547,737 B2 6/2009 Kochvar et al.
7,563,757 B2 7/2009 Kouvroukoglou et al.
7,708,840 B2 5/2010 Wiedemann et al.
7,727,946 B2 6/2010 Catalfamo et al.
7,824,588 B2 11/2010 Yang et al.
7,856,989 B2 12/2010 Karies et al.
7,967,801 B2 6/2011 Hammons et al.
8,338,358 B2 12/2012 Bernhardt
8,349,232 B2 1/2013 Pourdeyhimi et al.
8,785,361 B2 7/2014 Sivik
9,074,305 B2 7/2015 Glenn, Jr.
9,163,205 B2 10/2015 Sivik
9,175,250 B2 11/2015 Sivik
9,267,095 B2 2/2016 Delaney
9,421,153 B2 8/2016 Sivik
9,480,628 B2 11/2016 Sivik
9,493,726 B2 11/2016 Vinson
9,796,948 B2 10/2017 Shearouse
10,045,915 B2 8/2018 Glenn, Jr.
2001/0037851 A1 11/2001 Mortellite et al.
2002/0013251 A1 1/2002 Hayashi
2002/0018906 A1 2/2002 Clark
2002/0094942 A1* 7/2002 Danneels ..... B65D 83/0409 510/295
2002/0098994 A1 7/2002 Zafar
2002/0161088 A1 10/2002 Kochvar et al.
2002/0173213 A1 11/2002 Chu et al.
2003/0017208 A1 1/2003 Ignatious et al.
2003/0045446 A1 3/2003 Dihora et al.
2003/0166495 A1 9/2003 Wang et al.
2003/0185872 A1 10/2003 Kochinke
2003/0216098 A1 11/2003 Carlyle
2003/0224959 A1 12/2003 Smith
2004/0129032 A1 7/2004 Severns
2004/0167256 A1 8/2004 Verrall et al.
2004/0170836 A1 9/2004 Bond et al.
2004/0180597 A1 9/2004 Kamada et al.
2004/0204543 A1 10/2004 Yang
2005/0003048 A1 1/2005 Pearce et al.
2005/0003980 A1 1/2005 Baker
2005/0003991 A1 1/2005 MacQuarrie
2005/0008776 A1 1/2005 Chhabra et al.
2005/0010010 A1 1/2005 Kitamura et al.
2005/0136112 A1 6/2005 Gonzales et al.
2005/0136780 A1 6/2005 Clark et al.
2005/0186256 A1 8/2005 Dihel et al.
2005/0209574 A1 9/2005 Boehringer et al.
2005/0281757 A1 12/2005 Ibrahim et al.
2006/0013869 A1 1/2006 Ignatious et al.
2006/0035042 A1 2/2006 Morken
2006/0083784 A1 4/2006 Ignatious et al.
2006/0111261 A1 5/2006 Sadlowski
2006/0118451 A1* 6/2006 Edwards ..... B65D 65/46 206/525.1
2006/0127458 A1 6/2006 Kiser et al.
2006/0134412 A1 6/2006 Mackey et al.
2006/0160453 A1 7/2006 Suh
2006/0189772 A1 8/2006 Scheibel et al.
2006/0205628 A1 9/2006 Deinhammer
2006/0254013 A1 11/2006 Konishi et al.
2006/0254014 A1 11/2006 Konishi et al.

(56) References Cited

U.S. PATENT DOCUMENTS

2006/0258251 A1 11/2006 Konishi et al.
2006/0264130 A1 11/2006 Karies et al.
2007/0054579 A1 3/2007 Baker et al.
2007/0110792 A9 5/2007 Simon
2007/0128256 A1 6/2007 Aubrun-Sonneville
2007/0134304 A1 6/2007 Aubrun-Sonneville et al.
2007/0134481 A1 6/2007 Aubrun-Sonneville
2007/0253926 A1 11/2007 Tadrowski et al.
2007/0259170 A1 11/2007 Brown et al.
2007/0259996 A1 11/2007 Vicari et al.
2007/0298064 A1 12/2007 Koslow
2008/0035174 A1 2/2008 Aubrun-Sonneville et al.
2008/0108748 A1 5/2008 Buckley et al.
2008/0118727 A1 5/2008 Andersen
2008/0146481 A1 6/2008 Brown et al.
2008/0149119 A1 6/2008 Marquez et al.
2008/0190998 A1* 8/2008 Schulhof ..... B65D 27/00 229/75
2008/0220054 A1 9/2008 Shastri et al.
2008/0226919 A1 9/2008 Hosoda et al.
2008/0242572 A1 10/2008 Icht et al.
2008/0269095 A1 10/2008 Aubrun-Sonneville
2009/0004254 A1 1/2009 Maibach
2009/0041820 A1 2/2009 Wu et al.
2009/0061496 A1 3/2009 Kuhn et al.
2009/0061719 A1 3/2009 Shibutani et al.
2009/0155326 A1 6/2009 Mack et al.
2009/0181587 A1 7/2009 Kang et al.
2009/0249558 A1 10/2009 Fileccia et al.
2009/0250370 A1* 10/2009 Whitchurch ..... B32B 27/306 206/524.2
2009/0285718 A1 11/2009 Privitera et al.
2009/0291282 A1 11/2009 Kitamura et al.
2010/0018641 A1 1/2010 Branham et al.
2010/0021517 A1 1/2010 Ahlers et al.
2010/0105821 A1 4/2010 Verrall et al.
2010/0166854 A1 7/2010 Michniak-Kohn et al.
2010/0196440 A1 8/2010 Stark et al.
2010/0266668 A1 10/2010 Coffee et al.
2010/0279905 A1 11/2010 Glenn, Jr. et al.
2010/0285101 A1 11/2010 Moore et al.
2011/0136719 A1 6/2011 Jalbert et al.
2011/0159267 A1 6/2011 Lee et al.
2011/0223381 A1 9/2011 Mackey et al.
2011/0230112 A1 9/2011 Rosé et al.
2011/0301070 A1 12/2011 Ochomogo et al.
2012/0021026 A1 1/2012 Chhabra et al.
2012/0027838 A1 2/2012 Gordon et al.
2012/0048769 A1 3/2012 Sivik et al.
2012/0052036 A1 3/2012 Glen, Jr. et al.
2012/0053103 A1 3/2012 Sivik et al.
2012/0053108 A1 3/2012 Glen, Jr. et al.
2012/0058166 A1 3/2012 Glen, Jr. et al.
2012/0082037 A1 3/2012 Sivik et al.
2012/0154300 A1 6/2012 Ma
2012/0172831 A1 7/2012 Darcy et al.
2012/0215148 A1 8/2012 Ewert et al.
2012/0237576 A1 9/2012 Gordon et al.
2013/0171421 A1 7/2013 Weisman et al.
2013/0172226 A1 7/2013 Dreher et al.
2014/0287973 A1 9/2014 Sivik et al.
2014/0366294 A1 12/2014 Roe
2015/0048001 A1 2/2015 Bailey
2015/0071572 A1* 3/2015 Dreher ..... B65D 29/00 383/105
2015/0104856 A1 4/2015 Astrid
2015/0313807 A1 11/2015 Lynch
2016/0010041 A1 1/2016 Sivik
2016/0040105 A1 2/2016 Depoot et al.
2016/0101204 A1 4/2016 Lynch
2016/0151529 A1* 6/2016 Rabin ..... A61L 9/014 512/5
2016/0186095 A1 6/2016 Vockenroth
2016/0200501 A1 7/2016 Lee
2016/0271021 A1 9/2016 Glenn, Jr.
2016/0340624 A1 11/2016 Sivik
2016/0374906 A1 12/2016 Sivik
2017/0009191 A1 1/2017 Maes
2017/0067002 A1 3/2017 Cumming
2017/0164612 A1 6/2017 Ripberger
2017/0320105 A1 11/2017 Roozrokh
2017/0335237 A1* 11/2017 Fossum ..... C11D 3/3776
2018/0216285 A1* 8/2018 Pratt ..... B32B 7/12
2018/0216286 A1* 8/2018 Glassmeyer ..... C11D 17/044
2018/0216287 A1* 8/2018 Weisman ..... C11D 17/049
2018/0216288 A1* 8/2018 Weisman ..... B32B 7/09
2018/0223229 A1 8/2018 Tan
2018/0334643 A1* 11/2018 Hamersky ..... A61K 8/342
2018/0334644 A1* 11/2018 Hamersky ..... A61K 8/416
2018/0338890 A1 11/2018 Glenn, Jr.
2018/0339822 A1* 11/2018 O'Donnell ..... B65D 75/245
2019/0233780 A1* 8/2019 Huang ..... D06M 23/08
2019/0233781 A1* 8/2019 Huang ..... D06M 16/003

FOREIGN PATENT DOCUMENTS

DE 10 2007 011606 A1 9/2008
EP 1 275 368 A1 1/2003
EP 1 306 425 A2 5/2003
EP 1 409 628 B1 2/2006
EP 1 512 701 B1 6/2006
EP 1 887 036 A2 2/2008
EP 1 888 036 2/2008
EP 1 436 376 B1 4/2010
EP 2 226 379 A1 9/2010
EP 1 948 771 B1 12/2010
EP 2 319 965 A1 5/2011
EP 2 363 432 A1 9/2011
EP 2 363 517 A1 9/2011
EP 2 395 142 A1 12/2011
GB 2107579 A 5/1993
GB 2375542 11/2002
GB 2449418 11/2008
HU 221299 B1 9/2002
JP 62-156348 7/1987
JP 3040879 A 2/1991
JP 3101618 A 4/1991
JP 09279457 10/1997
JP 10008364 1/1998
JP 10158700 A 6/1998
JP 2000169896 A 6/2000
JP 2009079329 4/2009
WO WO 1992/006603 A1 4/1992
WO WO 1994/002377 A1 2/1994
WO WO 94/04656 A2 3/1994
WO WO 95/23888 A1 9/1995
WO WO 99/57155 11/1999
WO WO 2000/013680 A2 3/2000
WO WO0027958 A1 5/2000
WO WO 01/25322 A1 4/2001
WO WO 2001/54667 A1 8/2001
WO WO 02/30786 A1 * 4/2002
WO WO 03/060007 A1 7/2003
WO WO 2004/009335 A1 1/2004
WO WO 2004/081162 A1 9/2004
WO WO 2005/068604 A1 7/2005
WO WO 2006/106514 A2 10/2006
WO WO 2007/089259 A1 8/2007
WO WO 2007/093558 A3 1/2008
WO WO 2009/022761 A1 2/2009
WO WO 2007/014221 A3 4/2009
WO WO2009047124 4/2009
WO WO 2009/103576 A1 8/2009
WO WO 2009/121900 A1 10/2009
WO WO 2010/015709 A2 2/2010
WO WO 2011/153023 A1 12/2011
WO WO2012003367 A3 3/2012
WO WO2017096354 A1 6/2017

OTHER PUBLICATIONS

PCT Search Report for appl. No. PCT/CN2017/087707, dated Feb. 24, 2018, 12 pages.

(56) References Cited

OTHER PUBLICATIONS

PCT Search Report for appl. No. PCT/US2017/046391, dated Nov. 8, 2017, 17 pages.
PCT Search Report for appl. No. PCT/US2018/015357, dated Apr. 11, 2018, 14 pages.
PCT Search Report for appl. No. PCT/US2018/015358, dated Apr. 16, 2018, 15 pages.
PCT Search Report for app. No. PCT/US2019/014452, dated Apr. 8, 2019, 14 pages.
PCT Search Report for appl. No. PCT/U52019/014453, dated Apr. 8, 2019, 15 pages.
PCT Search Report for appl. No. PCT/U52019/014454, dated Apr. 5, 2019, 15 pages.
PCT Search Report for appl. No. PCT/US2019/014455, dated Apr. 5, 2019, 15 pages.
PCT Search Report for appl. No. PCT/US2019/014443, dated Apr. 17, 2019, 15 pages.
PCT Search Report for appl. No. PCT/US2019/014444, dated Apr. 16, 2019, 15 pages.
PCT Search report for appl. No. PCT/U52019/014451, dated Apr. 24, 2019, 12 pages.
PCT Search Report for appl. No. PCT/US2019/019547, dated May 22, 2019, 12 pages.
PCT Search Report for appl. No. PCT/US2019/049727, dated Jan. 2, 2020, 12 pages.
PCT Search report for appl. No. PCT/US2019/040240, dated Dec. 9, 2019, 15 pages.
PCT Search Report for appl. No. PCT/US19/40242, dated Oct. 22, 2019, 14 pages.
PCT Search Report for appl. No. PCT/US2019/052321, 12 pages, dated Dec. 12, 2019.
EP Search Report for appl. No. 19163586.1-1105, dated Sep. 30, 2019, 8 pages.
Search Report for appl. No. 19163588.7-1105, dated Sep. 30, 2019, 7 pages.
PCT Search Report for appl. No. PCT/CN2017/072926, dated Feb. 6, 2017, 5 pages.
PCT Search Report for appl. No. PCT/CN2017/072927, dated Feb. 6, 2017, 6 pages.
PCT Search Report for appl. No. PCT/CN2017/072935, dated Jun. 9, 2017, 4 pages.
PCT appl. No. PCT/CN2018/074281, dated Aug. 29, 2019, 7 pages.
PCT Search Report for appl. No. PCT/ CN2018/ 074282, dated Oct. 22, 2018, 5 pages.
PCT Search Report for App. No. PCT/USS2019/060216, dated Apr. 3, 2020, 14 pages.
PCT Search Report for App. No. PCT/US2020/015189, dated May 7, 2020. 15 pgs.
Makadia, et al., "Poly Lactic-co-Glycolic Acid (PLGA) as Biodegradable Controlled Drug Delivery Carrier", Polymers, 3, pp. 1377-1397 (2011).
Smith, et al., "Nanofibrous Scaffolds and Their Biological Effects", Nantechnologies for the Life Sciences, vol. 9, pp. 188-215 (2006).
Wang, et al., "A Novel Controlled Release Drug Delivery System for Multiple Drugs Based on Electrospun Nanofibers Containing Nanoparticles", Journal of Pharmaceutical Sciences, vol. 99, No. 12 (Dec. 2010).

* cited by examiner

CONSUMER PRODUCT COMPRISING A FLAT PACKAGE CONTAINING UNIT DOSE ARTICLES

FIELD OF THE INVENTION

The present disclosure relates to a container system comprising a flat package, which has walls that define an interior space, and at least one fibrous water-soluble unit dose article in the interior space, where the fibrous water-soluble unit dose article comprises household care active agents.

BACKGROUND OF THE INVENTION

According to some data, e-commerce is growing 23% year-over-year and 51% of Americans prefer online shopping. Furthermore, the growing popularity of voice shopping, using devices such as Amazon's Alexa, is predicted to make e-commerce grow at an even faster rate in the coming years. Consumer products, particularly household products, are not immune from the trend toward e-commerce. More and more, consumers desire to purchase household products, such as laundry detergent, online and have the household products shipped directly to his or her mailbox. However, some conventional forms of laundry detergents, such as liquids and powders, may be difficult and expensive to ship, due to the weight of these detergent products. Also, some forms, such as liquids, may not be sustainable to ship, due to the amount of water in the products. Even the newest and most compact form of laundry detergent, water-soluble unit dose pouches, are not ideal for e-commerce delivery to mailboxes, due to the size of the pouches, the dimensions of the pouches, and/or the amount of liquid contained in the pouches.

Water-soluble unit dose pouches have grown in popularity as these pouches provide a convenient, efficient, and clean way of dosing a laundry detergent. As an alternative to pouches, fibrous water-soluble unit dose articles are of increasing interest. Fibrous water-soluble unit dose articles provide the convenience of unit dose pouches and may be designed for optimal e-commerce delivery to mailboxes. Fibrous water-soluble unit dose articles are light in weight, sustainable—due to low water content, and may be packaged in a manner that both appeals to consumers and ships economically via existing mail services. Furthermore, the technology related to such fibrous articles continues to advance in terms of providing the desired active agents with the articles enabling the consumers to do the job that they wish to accomplish. Consumers desire fibrous water-soluble unit dose articles that clean as well or better than conventional forms of fabric treatment compositions, such as liquids, powders, and unit dose pouches constructed of water-soluble films.

Thus, there is a need for sustainable unit dose detergent products that perform as well or better than conventional detergent products and may be packaged in a manner that both appeals to consumers and ships economically via existing mail services to the consumer's mailbox.

Surprisingly, it has been found that a better performing detergent product can be shipped economically to a consumer's mailbox by providing a flat package having walls that define an interior space and at least one fibrous water-soluble unit dose article, which comprises household care active agents, in the interior space.

SUMMARY OF THE INVENTION

The present disclosure relates to a container system comprising: a flat package having walls that define an interior space; at least one fibrous water-soluble unit dose article in the interior space, the fibrous water-soluble unit dose article comprising household care active agents.

DETAILED DESCRIPTION OF THE INVENTION

Definitions

Figure 1:
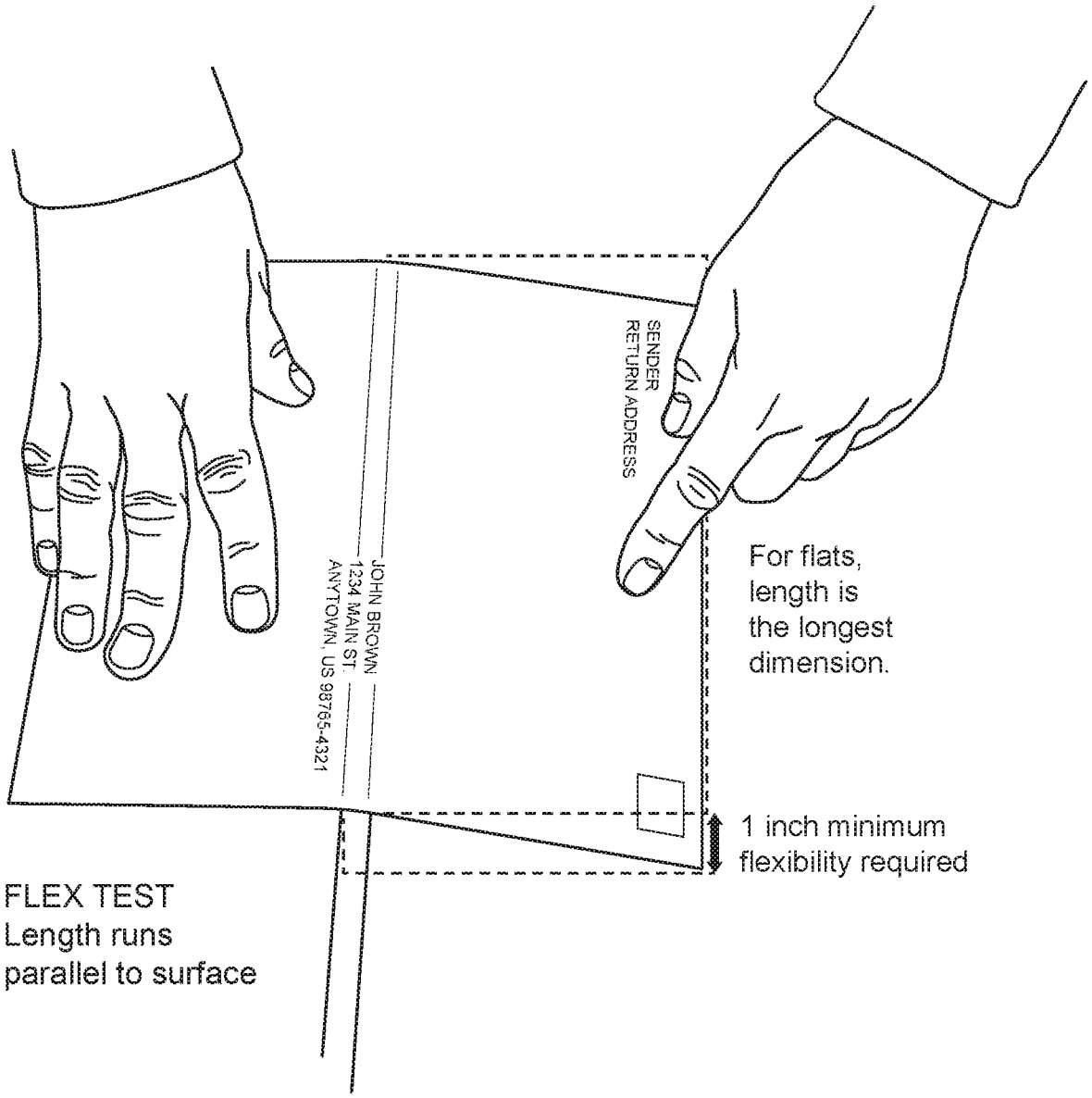
FIG. 1 demonstrates the minimum flexibility test for a flat package.

As used herein, the term "flat" means a package that has a substantially uniform thickness, meaning that any bumps, protrusions, or other irregularities do not cause more than ¼-inch (0.635 cm) variance in thickness.

As used herein, the term "flexible," as in flexible package, flexible flat, or flexible flat package refers to a package that meets the standards of the Minimum Flexibility for Flat Packages Test Method and the Maximum Deflection for Flat Packages Test Method.

Flat Package

The flat package has walls that define an interior space, where at least one fibrous water-soluble unit dose article is in the interior space. Flat packages are advantageous because the sorting rate for flat packages is much greater than the sorting rate for parcels (e.g., boxes), leading to throughput efficiency. Additionally, flat packages save space and this space saving may have a significant impact on vehicle fill during transportation, leading to vehicle fill efficiencies. The flat package may be flexible, meaning that the package has a flexibility and a droop (also known as vertical deflection) that meets the shipping guidelines of various mail services, such as the United States Postal Service.

The flat package may comprise an opening feature and may or may not be re-closable. The flat package may be lined with cushioning to protect the articles from damage. The flat package may be a padded or unpadded mailer. Examples of flat packages include poly mailers, bubble mailers, paper envelopes, paperboard mailers, chipboard mailers, and Tyvek® mailers. A variety of flat packages are available from Uline, 12575 Uline Drive, Pleasant Prairie, Wis. 53158. The flat package may be printed on. Branding, artwork, Quick Response (QR) codes, and/or subscription links may be printed on the package.

The length of the flat package is its longest dimension. The height is the dimension perpendicular to the length. The length and width may be the same. The flat package may have a height of no more than about 0.75 inches (1.905 cm). The flat package may have a height of no less than about 0.25 inches (0.635 cm). The flat package may have a length of no more than about 15 inches (38.1 cm) and a width of no more than about 12 inches (30.48 cm). The flat package may have a length of no less than about 11.5 inches (29.21 cm) and a width of no less than about 6.125 inches (15.5575 cm).

Article(s) in Flat Package

The flat package may contain as few as one fibrous water-soluble unit dose article. The flat package may contain two or more fibrous water-soluble unit dose articles (a plurality of fibrous water-soluble unit dose articles).

The fibrous water-soluble unit dose articles may be stacked in the flat package. Preferably, the articles are stackable, meaning that the articles are flat and stable when stacked. The fibrous water-soluble unit dose articles described herein may be stacked in the flat package. The fibrous water-soluble unit dose articles are highly compact vehicles for delivering laundry actives. The fibrous water-soluble unit dose articles may contain particles, which may provide additional performance, while maintaining the compactness of the article. The fibrous water-soluble unit dose articles may be stacked in a two- or three-dimensional array, preferably a three-dimensional array. This enables the manufacturer to maximize the concentration of active agent(s) per square meter of the flat package.

The article(s) are preferably in a fixed position in the flat package. By "fixed position" it is meant that the article(s) do not shift (e.g., during shipping) to such an extent that the flat package is no longer flat, in other words, shifting that leads to the formation of bumps, protrusions, or other irregularities that cause more than ¼-inch (0.635 cm) variance in thickness of the package. The fixed position of the article(s) may be accomplished in any number of ways.

The fixed position may be accomplished by providing a plurality of articles—two or more articles—that are detachably connected to each other, such that the articles cannot move relative to each other, for example, the articles cannot slide over each other. The plurality of detachably connected articles may move relative to the flat package, provided that the package remains flat.

The fixed position may be accomplished by adhering, using any number of known adhesives, individual articles or groups of articles to the flat package itself or to an insert in the flat package, such as tray, e.g., thermoformed tray, or paperboard. Alternatively, if the flat package contains a tray having compartments for the articles, then the articles may not need to be adhered to the tray.

The fixed position may be accomplished by wrapping articles, in a film using any number of known methods, including flow wrapping, shrink wrapping, overwrapping, diefold wrapping. The edges of the film may be sealed using any number of known methods, including pressure sealing, heat sealing, and vacuum sealing. Alternatively, pre-made plastic bags may be used and may be sealed using any one of the methods described above. The articles may be wrapped such that all of the articles are located in a single compartment (e.g., all articles located in a single, sealed bag).

The articles may be wrapped such that each individual article or every two or more articles, e.g., every three articles, every four articles, every ten articles, every twelve articles, are located in a single compartment, preferably separated from any remaining articles (when there are remaining articles). For example, twelve articles may be wrapped such that each article is in its own compartment (for a total of 12 compartments). Alternatively, twelve articles may be arranged in three columns and four rows, where each column of articles is sealed or each row of articles is sealed, e.g., heat sealed, (and therefore separated from other column(s) or row(s)) and contains four articles (columns) or three articles (rows). The compartments may be formed by sealing the film at the periphery of each article, where sealing is accomplished as described above (e.g., heat sealing, cold sealing, pressure sealing). The compartments may include opening features, which may or may not be reclosable.

One skilled in the art will appreciate that there are numerous ways to arrange a plurality of articles in compartments in a wrapping, depending on the number and shape of the articles. The articles are preferably arranged and wrapped to form a flat sheet—a sheet having substantially uniform thickness. The flat package may contain one flat sheet or several flat sheets stacked together.

Fibrous Water-Soluble Unit Dose Article

As used herein, the phrases "water-soluble unit dose article," "water-soluble fibrous structure", and "water-soluble fibrous element" mean that the unit dose article, fibrous structure, and fibrous element are miscible in water.

These fibrous water-soluble unit dose articles can be dissolved under various wash conditions, e.g., low temperature, low water and/or short wash cycles or cycles where consumers have been overloading the machine, especially with items having high water absorption capacities, while providing sufficient delivery of active agents for the intended effect on the target consumer substrates (with similar performance as today's liquid products). Furthermore, the water-soluble unit dose articles described herein can be produced in an economical manner by spinning fibers comprising active agents. The water-soluble unit dose articles described herein also have improved performance.

A single package of water-soluble unit dose articles may contain different unit dose articles. The different articles may or may not be wrapped and may or may not be in separate compartments, as described above. Non-limiting examples of differences between the unit dose articles in a package may be physical differences, such as differences in size (length/width/thickness), texture, shape, rigidness, elasticity, number of plies, number of layers, how the plies/layers are put together to form the article (e.g., three-ply article, where the inner ply contains active agents and the two outer plies do not contain active agents), and the like; chemical differences, such as different active agents, different filament-forming materials, different colors, different levels of active agent, different basis weights, different levels of filament-forming material, presence of a coating on the article, comprising renewable and/or biodegradable materials (e.g., as active agent or as filament forming material), different hydrophobicity/hydrophilicity; differences in how the article loses its physical structure when the article is exposed to conditions of intended use; and differences in rate at which the article releases one or more of its active agents when it is exposed to conditions of intended use. The articles may be different, identical, or substantially identical, from a compositional perspective. For example, two or more articles in the package may comprise different active agents or different levels of active agents. This may be the case where the different articles provide different benefits, e.g., whitening, cleaning, different scents, or where the different active agents may be incompatible with one another, for example a bleach and perfume. The different articles may differ in wetting, imbibitions, and solubility characteristics.

A package may contain unit dose articles of different sizes. A package may contain a plurality, such as a sheet, of unit dose articles of different sizes, where the consumer may select the size he or she desires for a particular load of laundry. The plurality of different-sized unit dose articles, such as a sheet, may include perforations (or some other feature that serves as an aid in separating the unit dose articles from one another). A package containing unit dose articles of different sizes provides the flexible dosing of a powder or a liquid, without the messiness of these forms. A package may contain unit dose articles having one or more of the differences described above and having different sizes.

The fibrous water-soluble unit dose article can have a mass from about 50 mg to about 40 g, optionally about 100 mg to about 20 g, optionally about 1 g to about 20 g. The fibrous water-soluble unit dose article can have a length and width from about 5 mm to about 20 cm, optionally from about 3 cm to about 15 cm, optionally from about 1 cm to about 10 cm, and a thickness from about 1 mm to about 2 cm, optionally about 2 mm to about 10 mm, optionally from about 2 mm to about 8 mm.

The fibrous water-soluble unit dose article may have a width from about 1 cm to about 11 cm; a length from about 1 cm to about 20 cm; and a height from about 0.01 mm to about 50 mm.

The surface of the fibrous water-soluble unit dose article may comprise a printed area. The printed area may cover between about 10% and about 100% of the surface of the article. The area of print may comprise inks, pigments, dyes, blueing agents or mixtures thereof. The area of print may be opaque, translucent or transparent. The area of print may comprise a single color or multiple colors. The printed area maybe on more than one side of the article and contain instructional text and/or graphics. The surface of the water-soluble unit dose article may comprise an aversive agent, for example a bittering agent. Suitable bittering agents include, but are not limited to, naringin, sucrose octacetate, quinine hydrochloride, denatonium benzoate, or mixtures thereof. Any suitable level of aversive agent may be used. Suitable levels include, but are not limited to, 1 to 5000 ppm, or even 100 to 2500 ppm, or even 250 to 2000 ppm.

The fibrous water-soluble unit dose articles may exhibit a thickness of greater than 0.01 mm and/or greater than 0.05 mm and/or greater than 0.1 mm and/or to about 100 mm and/or to about 50 mm and/or to about 20 mm and/or to about 10 mm and/or to about 5 mm and/or to about 2 mm and/or to about 0.5 mm and/or to about 0.3 mm as measured by the Thickness Test Method described herein.

The fibrous water-soluble unit dose articles may have basis weights of from about 500 grams/$m^2$ to about 5,000 grams/$m^2$, or from about 1,000 grams/$m^2$ to about 4,000 grams/$m^2$, or from about 1,500 grams/$m^2$ to about 3,500 grams/$m^2$, or from about 2,000 grams/$m^2$ to about 3,000 grams/$m^2$, as measured according to the Basis Weight Test Method described herein.

The fibrous water-soluble unit dose article may exhibit different regions, such as different regions of basis weight, density, caliper, and/or wetting characteristics. The fibrous water-soluble unit dose article may be compressed at the point of edge sealing. The fibrous water-soluble unit dose article may comprise texture on one or more of its surfaces. A surface of the fibrous water-soluble unit dose article may comprise a pattern, such as a non-random, repeating pattern. The fibrous water-soluble unit dose article may comprise apertures. The fibrous water-soluble unit dose article may comprise a fibrous structure having discrete regions of fibrous elements (and, optionally, particles) that differ from other regions of fibrous elements (and, optionally, particles) in the structure. For example, one region of the article may comprise bleaching agents and/or surfactants and another region of the article may comprise softening agents. The fibrous water-soluble unit dose article may be used as is or it may be coated with one or more active agents.

The fibrous water-soluble unit dose article can be viewed hierarchically starting from the form in which the consumer interacts with the water-soluble article and working backward to the raw materials from which the water-soluble article is made, e.g., fibrous water-soluble unit dose articles, fibrous structures, fibrous elements. The fibrous structures can be fibrous plies and the fibrous water-soluble unit dose article may comprise one or more plies. The fibrous water-soluble unit dose article may comprise at least two and/or at least three and/or at least four and/or at least five plies. Each ply may comprise one or more layers, for example one or more fibrous element layers or, when particles are present, one or more particle layers and/or one or more fibrous element/particle mixture layers. The layer(s) may be sealed. In particular, particle layers and fibrous element/particle mixture layers may be sealed, such that the particles do not leak out. The water-soluble unit dose articles may comprise multiple plies, where each ply comprises two layers, where one layer is a fibrous element layer and one layer is a fibrous element/particle mixture layer, and where the multiple plies are sealed (e.g., at the edges) together. Sealing may help the unit dose article maintain its original structure (as well as inhibit the leakage of particles, when present). However, upon addition of the water-soluble unit dose article to water, the unit dose article dissolves (and, when particles are present, releases the particles into the wash liquor).

Figure 9:
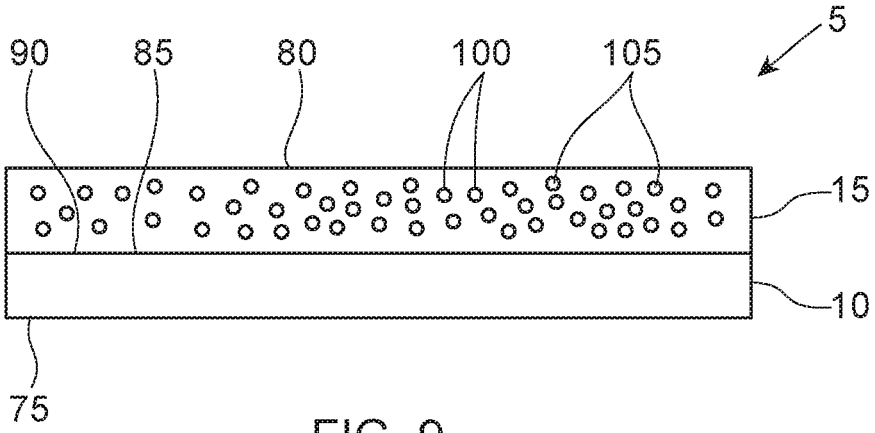
FIG. 9 is a cross section view of a two-ply product.

One or more of the plies may optionally be provided with particles comprising one or more active agents, by way of nonlimiting example as shown in FIG. 9. One or more plies may be free of particles. For instance, in FIG. 9, the first ply 10 does not comprise particles, while the second ply 15 can be provided with a plurality 100 of particles 105. Optionally, the outer surfaces of the article 5 can comprise the belt side surfaces of the plies. For instance, the first ply belt side 75 and the second ply belt side 80 can positioned to face away from one another prior to joining the first ply 10 and second ply 15. Described otherwise, the first ply air side 90 and the second ply air side 85 can face towards one another prior to joining the first ply 10 and second ply 15. The article 5 may have multiple plies and optionally multilayer plies. Multiple plies and multilayer plies enable the manufacturer to provide for different benefits in each ply or layer, provide active agents away from the layers forming the outer surface of the article 5, surfaces that are convenient to print upon, and provide articles 5 that are pleasant to touch.

Figure 10:
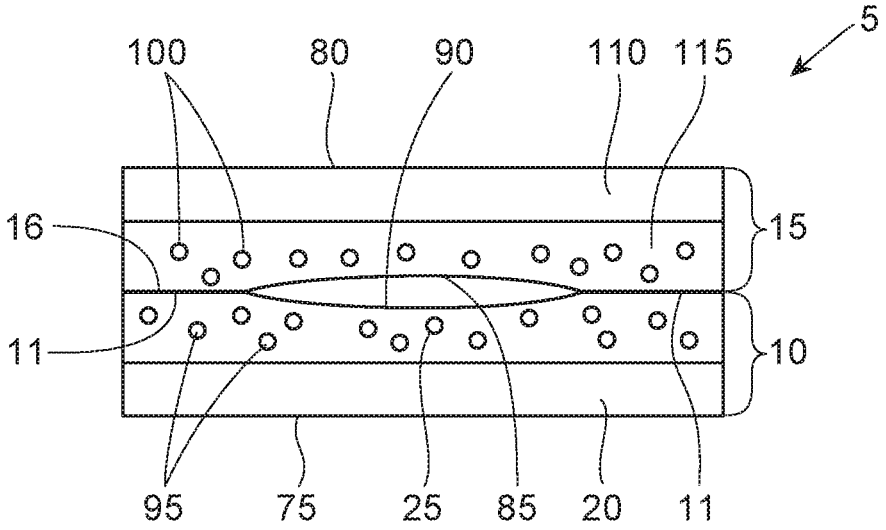
FIG. 10 is a cross section view of a two-ply product, each ply being a multilayer ply.

As shown in FIG. 10, the first ply 10 can comprise a fibrous first layer 20 and a fibrous second layer 25. The first layer 20 and the second layer 25 can together form the first ply 10. The second layer 25 and the first layer 20 can be in facing and contacting relationship with one another, for instance as would occur if the second layer 25 is deposited on the first layer 20. The second layer 25 can comprise a first plurality 91 of water soluble first particles 95 distributed within the second layer 25. The process of manufacturing described herein can further comprise the steps of providing a fibrous third layer 110 and providing a fibrous fourth layer 115 facing, or in facing relationship with, the fibrous third layer. The third layer 110 and the fourth layer 115 can be in facing and contacting relationship with one another, for instance as would occur if the fourth layer 115 is deposited on the third layer 110. The second ply 15 can comprise the fibrous third layer 110 and the fibrous fourth layer 115. The third layer 110 and the fourth layer 115 can together form the second ply 15. The fourth layer 115 can comprise a second plurality 100 of water soluble second particles 105 distributed within the fourth layer 115. Multilayer plies enable the article designer to place active agents in chosen layers of the plies, optionally provide for different active agents in different layers of the plies, and optionally place active agents between the layers and or plies.

Figure 11:
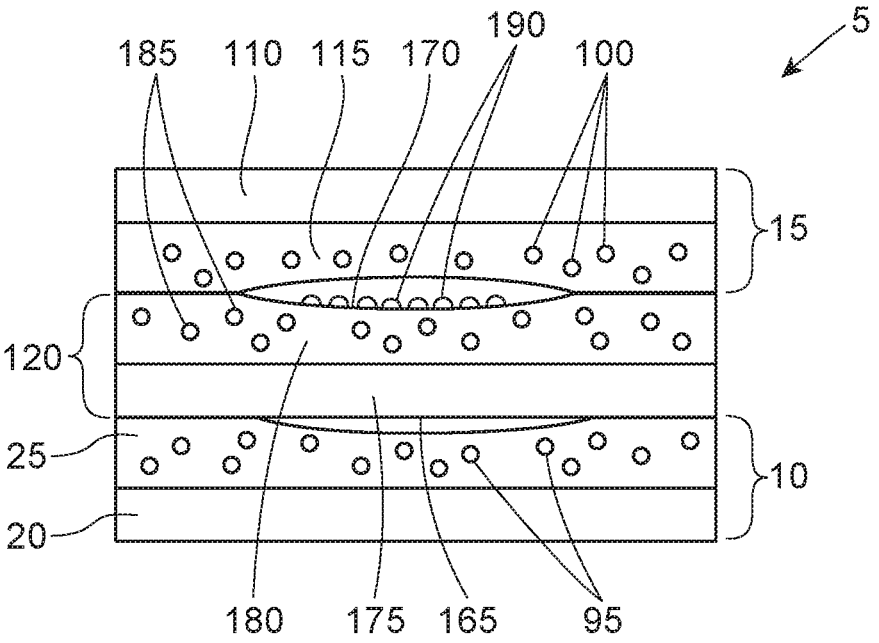
FIG. 11 is a cross section view of a three-ply product, each ply being a multilayer ply.
Figure 12:
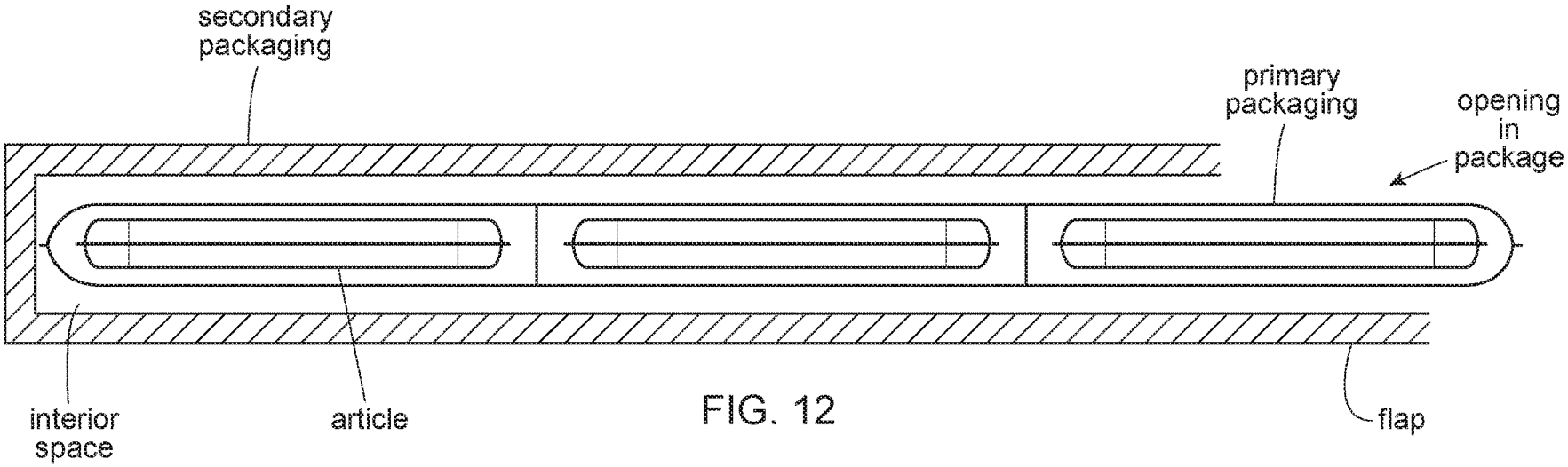
FIG. 12 is a cross section view of a flat package containing the articles.
Figure 13:
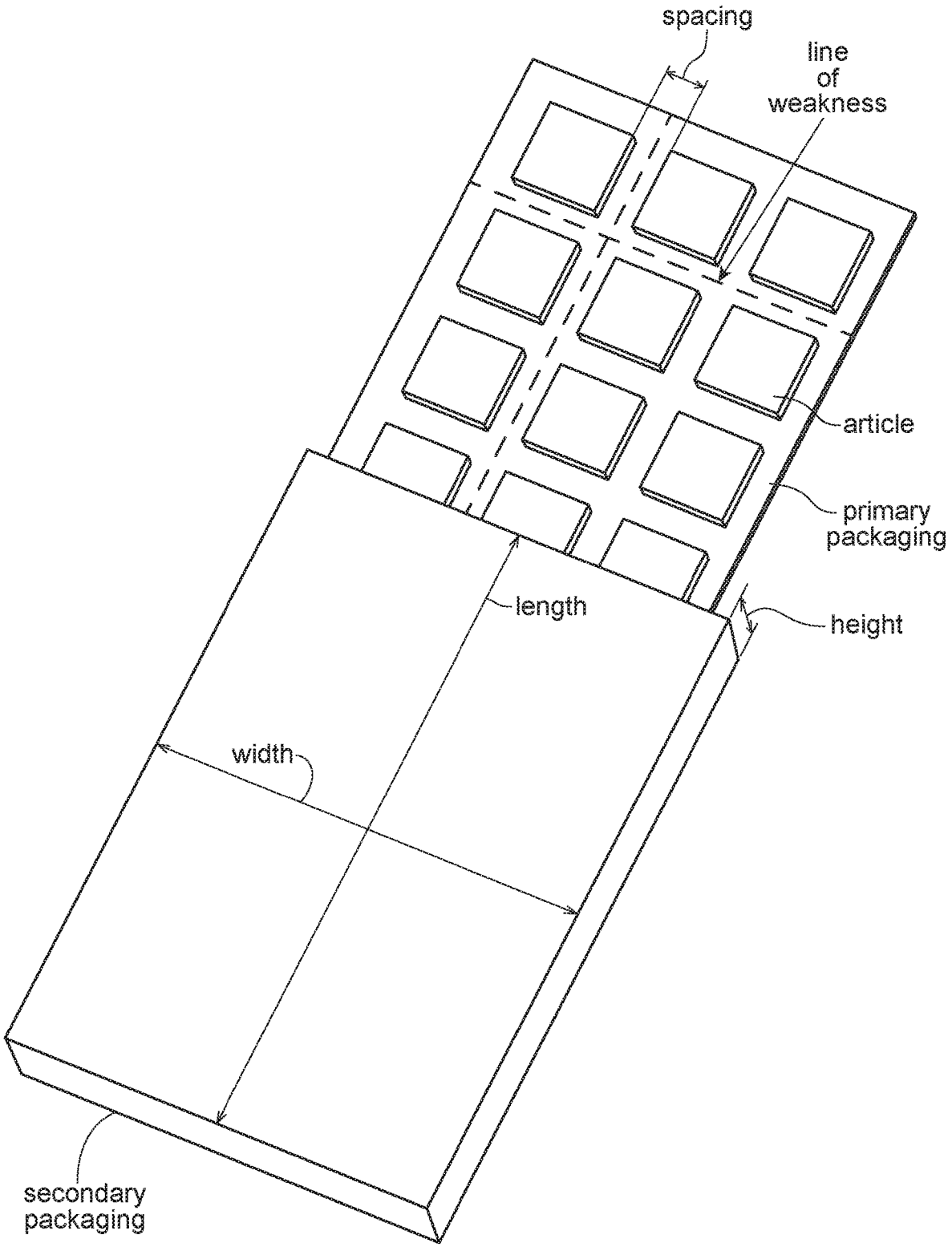
FIG. 13 is a perspective view of a flat package containing the articles.

A three ply article 5 is shown in FIG. 11. Each of the plies can be a multi-layer ply. There can be intermingling of fibers of one layer with fibers of another layer next thereto. There can also be intermingling of fibers of one ply with fibers of another layer or ply next thereto. As shown in FIG. 11, the third ply 120 can be between the first ply 10 and second ply 15. The third ply 120 can be a single layer ply or a multi-layer ply. The third ply 120 can have a third ply belt side 165 and third ply air side 170 opposite the third ply belt side 165. The third ply 120 can comprise a fibrous fifth layer 175 and a fibrous sixth layer 180. The fifth layer 175 and the sixth layer 180 together forming the third ply 120. Optionally, the third ply 120 can comprise a plurality of third particles 185. Further optionally, the sixth layer 180 can comprise third particles 185. One or more active agents 190 can be between the third ply 120 and the second ply 15. The third ply 120 can optionally be flipped relative to that shown in FIG. 9 with sixth layer 165 oriented towards the second layer 25. Likewise, the plies can be arranged in any desired order in any desired orientation.

Fibrous Structure

The fibrous water-soluble unit dose article may comprise a water-soluble fibrous structure and, where the water-soluble fibrous structure comprises a plurality of fibrous elements. The water-soluble unit dose article may comprise a plurality of two or more and/or three or more fibrous elements that are inter-entangled or otherwise associated with one another to form a fibrous structure. Fibrous structures may include particles within and or on the structure. Fibrous structures can be homogeneous, layered, unitary, zoned, or as otherwise desired, with different active agents defining the various aforesaid portions.

Fibrous Elements

In general, fibrous elements are elongated particulates having a length greatly exceeding average diameter, e.g., a length to average diameter ratio of at least about 10. A fibrous element may be a filament or a fiber. Filaments are relatively longer than fibers. A filament may have a length of greater than or equal to about 5.08 cm (2 in.), and/or greater than or equal to about 7.62 cm (3 in.), and/or greater than or equal to about 10.16 cm (4 in.), and/or greater than or equal to about 15.24 cm (6 in.). A fiber may have a length of less than about 5.08 cm (2 in.), and/or less than about 3.81 cm (1.5 in.), and/or less than about 2.54 cm (1 in.).

The fibrous elements may exhibit a diameter of less than about 300 μm, and/or less than about 75 μm, and/or less than about 50 μm, and/or less than about 25 μm, and/or less than about 10 μm, and/or less than about 5 μm, and/or less than about 1 μm as measured according to the Diameter Test Method described herein. The fibrous elements may exhibit a diameter of greater than about 1 μm as measured according to the Diameter Test Method described herein. The diameter of a fibrous element may be used to control the rate of release of one or more active agents present in the fibrous element and/or the rate of loss and/or altering of the fibrous element's physical structure.

The fibrous structure may comprise two or more different fibrous elements. Non-limiting examples of differences in the fibrous elements may be physical differences, such as differences in diameter, length, texture, shape, rigidness, elasticity, and the like; chemical differences, such as cross-linking level, solubility, melting point, Tg, active agent, filament-forming material, color, level of active agent, basis weight, level of filament-forming material, presence of any coating on fibrous element, biodegradable or not, hydrophobic or not, contact angle, and the like; differences in whether the fibrous element loses its physical structure when the fibrous element is exposed to conditions of intended use; differences in whether the fibrous element's morphology changes when the fibrous element is exposed to conditions of intended use; and differences in rate at which the fibrous element releases one or more of its active agents when the fibrous element is exposed to conditions of intended use. The fibrous elements may be different, identical, or substantially identical, from a compositional perspective. For example, two or more fibrous elements within the fibrous structure may comprise different active agents. This may be the case where the different active agents may be incompatible with one another, for example an anionic surfactant and a cationic polymer. When using different fibrous elements, the resulting structure may exhibit different wetting, imbibitions, and solubility characteristics.

The fibrous elements may be water-soluble. The fibrous elements may comprise one or more filament-forming materials and/or one or more active agents, such as a surfactant. The one or more active agents may be releasable from the fibrous element, such as when the fibrous element and/or fibrous structure comprising the fibrous element is exposed to conditions of intended use. The fibrous element may comprise two or more different active agents, which are compatible or incompatible with one another. The one or more active agents may be uniformly distributed or substantially uniformly distributed throughout the fibrous element. The one or more active agents may be distributed as discrete regions within the fibrous element. The one or more active agents may be selected from the group consisting of: enzymes, bleaching agents, builder, chelants, sensates, dispersants, perfumes, antimicrobials, antibacterials, antifungals, and mixtures thereof that are releasable and/or released when the fibrous element and/or fibrous structure comprising the fibrous element is exposed to conditions of intended use.

The fibrous elements of the present invention may be spun from a filament-forming composition, also referred to as fibrous element-forming compositions, via suitable spinning process operations, such as meltblowing, spunbonding, electro-spinning, and/or rotary spinning.

"Filament-forming composition" and/or "fibrous element-forming composition" as used herein means a composition that is suitable for making a fibrous element of the present invention such as by meltblowing and/or spunbonding. The filament-forming composition comprises one or more filament-forming materials that exhibit properties that make them suitable for spinning into a fibrous element. The filament-forming composition may comprise two or more different filament-forming materials. Thus, the fibrous elements may be monocomponent (one type of filament-forming material) and/or multicomponent, such as bicomponent. The two or more different filament-forming materials may be randomly combined or orderly combined—core and sheath, side-by-side, islands-in-the-sea—to form a bicomponent fibrous element.

The filament-forming material may comprise any suitable material, such as a polymer or monomers capable of producing a polymer, that exhibits properties suitable for making a filament, such as by a spinning process. In addition to one or more filament-forming materials, the filament-forming composition may comprise one or more active agents, for example, a surfactant. In addition, the filament-forming composition may comprise one or more polar solvents, such as an alcohol-soluble material and/or a water-soluble material, which can be beneficial for product applications that include use of water. The one or more, for example all, of the filament-forming materials and/or one or more, for example all, of the active agents are dissolved and/or dispersed in the polar solvent, prior to spinning a fibrous element, such as a filament, from the filament-forming composition. The filament-forming material may comprise a non-polar solvent-soluble material. The filament-forming material may comprise a water-soluble material and be free (less than 5% and/or less than 3% and/or less than 1% and/or 0% by weight on a dry fibrous element basis and/or dry fibrous structure basis) of water-insoluble materials.

Non-limiting examples of water-soluble materials include water-soluble polymers. The water-soluble polymers may be synthetic or natural original and may be chemically- and/or physically modified. Non-limiting examples of water-soluble polymers include water-soluble hydroxyl polymers, water-soluble thermoplastic polymers, water-soluble biodegradable polymers, water-soluble non-biodegradable polymers and mixtures thereof. The water-soluble polymer may comprise polyvinyl alcohol. In another example, the water-soluble polymer may comprise starch. The water-soluble polymer may comprise polyvinyl alcohol and starch. The water-soluble polymer may comprise carboxymethyl cellulose. The polymer may comprise carboxymethyl cellulose and polyvinyl alcohol.

Non-limiting examples of water-soluble hydroxyl polymers include polyols, such as polyvinyl alcohol, polyvinyl alcohol derivatives (a polyvinyl alcohol can be grafted with other monomers to modify its properties), polyvinyl alcohol copolymers, starch, starch derivatives, starch copolymers, chitosan, chitosan derivatives, chitosan copolymers, cellulose derivatives such as cellulose ether and ester derivatives, cellulose copolymers, hemicellulose, hemicellulose derivatives, hemicellulose copolymers, gums, arabinans, galactans, proteins, carboxymethylcellulose, and various other polysaccharides and mixtures thereof. The water-soluble hydroxyl polymer may be selected from the group consisting of: polyvinyl alcohols, hydroxymethylceiluloses, hydroxyethylcelluloses, hydroxypropylmethylcelluloses, carboxymethylcelluloses, and mixtures thereof. A non-limiting example of a suitable polyvinyl alcohol includes those commercially available from Sekisui Specialty Chemicals America, LLC (Dallas, Tex.) under the SELVOL (Registered trademark) trade name. Another non-limiting example of a suitable polyvinyl alcohol includes G Polymer commercially available from Nippon Ghosei. A non-limiting example of a suitable hydroxypropylmethylcellulose includes those commercially available from the Dow Chemical Company (Midland, Mich.) under the METHOCEL (Registered trademark) trade name including combinations with above mentioned polyvinyl alcohols.

Non-limiting examples of suitable water-soluble thermoplastic polymers include thermoplastic starch and/or starch derivatives, polylactic acid, polyhydroxyalkanoate, polycaprolactone, polyesteramides and certain polyesters, and mixtures thereof. The water-soluble thermoplastic polymers may be hydrophilic or hydrophobic. The water-soluble thermoplastic polymers may be surface treated and/or internally treated to change the inherent hydrophilic or hydrophobic properties of the thermoplastic polymer. The water-soluble thermoplastic polymers may comprise biodegradable polymers. Any suitable weight average molecular weight for the thermoplastic polymers may be used, e.g., between about 10,000 g/mol and about 500,000 g/mol.

The filament-forming material may comprise a polymer selected from the group consisting of: polyvinyl alcohol, polyvinyl alcohol derivatives, starch, starch derivatives, cellulose derivatives, hemicellulose, hemicellulose derivatives, proteins, sodium alginate, hydroxypropyl methylcellulose, chitosan, chitosan derivatives, polyethylene glycol, tetramethylene ether glycol, polyvinyl pyrrolidone, hydroxymethyl cellulose, hydroxyethyl cellulose, carboxymethyl cellulose, and mixtures thereof.

The filament-forming material may comprise a polymer selected from the group consisting of: pullulan, hydroxypropylmethyl cellulose, hydroxyethyl cellulose, hydroxypropyl cellulose, polyvinyl pyrrolidone, carboxymethylcellulose, sodium alginate, xanthan gum, tragacanth gum, guar gum, acacia gum, Arabic gum, polyacrylic acid, methylmethacrylate copolymer, carboxyvinyl polymer, dextrin, pectin, chitin, levan, elsinan, collagen, gelatin, zein, gluten, soy protein, casein, polyvinyl alcohol, carboxylated polyvinyl alcohol, sulfonated polyvinyl alcohol, starch, starch derivatives, hemicellulose, hemicellulose derivatives, proteins, chitosan, chitosan derivatives, polyethylene glycol, tetramethylene ether glycol, hydroxymethyl cellulose, and mixtures thereof.

The filament-forming material may comprise a polymer selected from the group consisting of: polymers derived from acrylic monomers such as the ethylenically unsaturated carboxylic monomers and ethylenically unsaturated monomers, polyvinyl alcohol, polyvinylformamide, polyvinylamine, polyacrylates, polymethacrylates, copolymers of acrylic acid and methyl acrylate, polyvinylpyrrolidones, polyalkylene oxides, starch and starch derivatives, pullulan, gelatin, and cellulose derivatives (for example, hydroxypropylmethyl celluloses, methyl celluloses, carboxymethy celluloses).

The fibrous element may comprise at least about 5%, and/or at least about 10%, and/or at least about 15%, and/or at least about 20%, and/or less than about 80%, and/or less than about 75%, and/or less than about 65%, and/or less than about 60%, and/or less than about 55%, and/or less than about 50%, and/or less than about 45%, and/or less than about 40%, and/or less than about 35%, and/or less than about 30%, and/or less than about 25% by weight on a dry fibrous element basis and/or dry fibrous structure basis of the filament-forming material and greater than about 20%, and/or at least about 35%, and/or at least about 40%, and/or at least about 45%, and/or at least about 50%, and/or at least about 55%, and/or at least about 60%, and/or at least about 65%, and/or at least about 70%, and/or at least about 80%, and/or less than about 95%, and/or less than about 90%, and/or less than about 85%, and/or less than about 80%, and/or less than about 75% by weight on a dry fibrous element basis and/or dry fibrous structure basis of an active agent, preferably surfactant. The total level of filament-forming materials present in the fibrous element may be from about 5% to less than about 80% by weight on a dry fibrous element basis and/or dry fibrous structure basis and the total level of surfactant present in the fibrous element may be greater than about 20% to about 95% by weight on a dry fibrous element basis and/or dry fibrous structure basis.

Preferably, each fibrous element may be characterized by a sufficiently high total surfactant content, e.g., at least about 30%, or at least about 40%, or at least about 50%, or at least about 60%, or at least about 70%, by weight on a dry fibrous element basis and/or dry fibrous structure basis of the surfactant.

The one or more filament-forming materials and active agents may be present in the fibrous element at a weight ratio of total level of filament-forming materials to active agents of about 2.0 or less, and/or about 1.85 or less, and/or less than about 1.7, and/or less than about 1.6, and/or less than about 1.5, and/or less than about 1.3, and/or less than about 1.2, and/or less than about 1, and/or less than about 0.7, and/or less than about 0.5, and/or less than about 0.4, and/or less than about 0.3, and/or greater than about 0.1, and/or greater than about 0.15, and/or greater than about 0.2. The one or more filament-forming materials and active agents may be present in the fibrous element at a weight ratio of total level of filament-forming materials to active agents of about 0.2 to about 0.7.

Particles

The fibrous water-soluble unit dose articles disclosed herein may optionally comprise one or more particles within or on the fibrous structure. The particles may contain soluble and/or insoluble material, where the insoluble material is dispersible in aqueous wash conditions to a suspension mean particle size that is less than about 20 microns. The particles may be water-soluble, e.g., substantially free of insoluble material. The particle may be discrete. As used herein, the term "discrete" refers to particles that are structurally distinctive from each other either under naked human eyes or under electronic imaging devices, such as scanning electron microscope (SEM) and transmission electron microscope (TEM). The particles may be discrete from each other under naked human eyes.

As used herein, the term "particle" refers to a solid matter of minute quantity. The particle may be a powder, granule, agglomerate, encapsulate, microcapsule, and/or prill. The particle may be made using a number of well known methods in the art, such as spray-drying, agglomeration, extrusion, prilling, encapsulation, pastillation and combinations thereof. The shape of the particle can be in the form of spheres, rods, plates, tubes, squares, rectangles, discs, stars, or flakes of regular or irregular shapes. The particles disclosed herein are generally non-fibrous.

The particles may have a relatively low water/moisture content (e.g., no more than about 10 wt % of total water/moisture, or no more than about 8 wt % of total water/moisture, or no more than about 5 wt % of total moisture), especially a relatively low free/unbound water content (e.g., no more than about 3 wt % of free or unbound water, or no more than about 1 wt % of free or unbound water), so that water from the particles will not compromise the structural integrity of the fibrous structure and so that the risk of gelling in the particles themselves is reduced. The water/moisture content present in a particle is measured using the following Water Content Test Method.

The bulk density of the particles may range from about 500 g/L to about 1000 g/L, or from about 600 g/L to about 900 g/L, or from about 700 g/L to about 800 g/L.

Like the fibrous structures and fibrous elements described hereinabove, the particles of are also characterized by a sufficiently high surfactant content, e.g., at least about 30%, or at least about 50%, or at least about 60%, and or at least about 70%, by total weight of each particle.

One or more of the particles may contain a surfactant having a relatively high hydrophilicity. Such surfactants are very effective in cleaning fabrics and removing stains and are therefore desirable to include in water-soluble unit dose articles disclosed herein. However, surfactants of higher hydrophilicity may form a viscous, gel-like hexagonal phase while being dissolved in water. It is therefore difficult to formulate such surfactants into the above-mentioned fibrous elements, because the viscous hexagonal phase may adversely affect processing of the fibrous elements and formation of the fibrous structure. Further, because the viscous hexagonal phase may slow down dissolution of the water-soluble unit dose articles in water during use, it is also helpful to formulate the such hydrophilic surfactants into particles that can be easily dispersed in water, which improves overall dissolution of the water-soluble unit dose articles during wash.

One or more of the particles may contain a surfactant selected from the group consisting of C6-C20 linear or branched alkylalkoxylated sulfates (AAS) having a weight average degree of alkoxylation ranging from about 0.1 to about 10, C6-C20 alkylalkoxylated alcohols (AA) having a weight average degree of alkoxylation ranging from about 5 to about 15, and combinations thereof. The surfactant may be a $C_6$-$C_{20}$ linear or branched AAS surfactant having a weight average degree of alkoxylation ranging from about 0.1 to about 10, or a $C_{10}$-$C_{16}$ linear or branched alkylethoxylated sulfate (AES) having a weight average degree of alkoxylation ranging from about 1 to about 5. Such AAS (e.g., AES) surfactant can be used either alone or in combination with other surfactants. The AAS (e.g., AES) surfactant may be used as a main surfactant in each particle, i.e., it is present at an amount that is 50% or more by total weight of all surfactants in the particle, while one or more other surfactants (anionic, nonionic, amphoteric, and/or cationic) may be present as co-surfactants for such AAS (e.g., AES). The particle may comprise from about 15 wt % to about 60 wt %, or from 20 wt % to 40 wt % alkylalkoxylated sulfate, or from 30 wt % to 80 wt % or even from 50 wt % to 70 wt % alkylalkoxylated sulfate.

Each of the particles may contain a nonionic surfactant. Suitable nonionic surfactants include alkylalkoxylated alcohols, such as alkylethoxylated alcohols and alkylethoxylated phenols of the formula $R(OC_2H_4)_nOH$, where R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. The nonionic surfactant may be $C_6$-$C_{20}$ alkylalkoxylated alcohols (AA) having a weight average degree of alkoxylation ranging from 5 to 15, which may be present in the particles either alone or in combination with the AAS or AES surfactant described hereinabove. AA can either be present as a main surfactant or as a co-surfactant for AAS or AES in the particles, for example, in a weight ratio of AA:AAS ranging from about 1:15 to about 1:2, or from about 1:10 to about 1:3, and or from about 1:8 to about 1:4.

The hydrophilic surfactant may be present in each of the particles in an amount ranging from about 20% to about 90%, or from about 30% to about 90%, or from about 40% to about 90%, or from about 50% to about 90%, by total weight of each particle.

In addition, the particles described herein may comprise one or more additional surfactants selected from the group consisting of other anionic surfactants (i.e., other than AAS and AES), amphoteric surfactants, cationic surfactants, and combinations thereof, as described hereinabove for the fibrous structure. Such additional surfactant(s) may be present in each of the particles in an amount ranging from about 0% to about 50% by total weight of each particle. For example, such additional surfactant(s) may be an anionic surfactant selected from the group consisting of C6-C20 linear or branched LAS, C6-C20 linear or branched AS, C6-C20 linear or branched alkyl sulfonates, $C_6$-$C_{20}$ linear or branched alkyl carboxylates, $C_6$-$C_{20}$ linear or branched alkyl phosphates, C6-C20 linear or branched alkyl phosphonates, $C_6$-$C_{20}$ alkyl N-methyl glucose amides, $C_6$-$C_{20}$ methyl ester sulfonates (MES), and combinations thereof. The particle may comprise from 1 wt % to 50 wt % alkylbenzene sulfonate, or from 5 wt % to 30 wt % alkylbenzene sulfonate.

The surfactant-containing particles described above may comprise one or more additional active agents (in addition to surfactant) for improving dissolution, assisting or enhancing cleaning performance, or to modify the aesthetics thereof.

One or more of the particles may further comprise from about 0.5% to about 20%, or from about 1% to about 15%, or from about 2% to about 10% by total weight of such particle of a rheology modifier. As used herein, the term "rheology modifier" means a material that interacts with concentrated surfactants, preferably concentrated surfactants having a mesomorphic phase structure, in a way that substantially reduces the viscosity and elasticity of said concentrated surfactant. Suitable rheology modifiers include, but are not limited to, sorbitol ethoxylate, glycerol ethoxylate, sorbitan esters, tallow alkyl ethoxylated alcohol, ethylene oxide-propylene oxide-ethylene oxide ($EOx_1POyEOx_2$) triblock copolymers wherein each of $x_1$ and $x_2$ is in the range of about 2 to about 140 and y is in the range of from about 15 to about 70, polyethyleneimine (PEI), alkoxylated variants of PEI, and preferably ethoxylated PEI, N,N,N',N'-tetraethoxylethylenediamine, and mixtures thereof. The rheology modifier is preferably a "functional rheology modifier," which means the rheology modifier has additional detergent functionality. The rheology modifier is preferably selected from the group consisting of an alkoxylated polyalkyleneimine, an ethylene oxide-propylene oxide-ethylene oxide ($EOx_1POyEOx_2$) triblock copolymer wherein each of $x_1$ and $x_2$ is in the range of about 2 to about 140 and y is in the range of from about 15 to about 70, an N,N,N',N'-tetraethoxylethylenediamine, and mixtures thereof.

The rheology modifier may comprise one of the polymers described above, for example, ethoxylated PEI, in combination with a polyalkylene glycol. When the particle comprises AAS or AES, the particle may further comprise from about 0.5% to about 20%, or from about 1% to about 15%, or from about 2% to about 10% of a polyalkylene glycol, by total weight of such each discrete particle. The polyalkylene glycol may be a polyethylene glycol with a weight average molecular weight ranging from 500 to 20,000 Daltons, or from about 1000 to 15,000 Daltons, and or from 2000 to 8000 Daltons.

The size distribution of the particles, as characterized according to the Granular Size Distribution Test Method, may have a D50 greater than about 150 μm and less than about 1600 μm, or a D50 greater than 205 μm and less than about 1000 μm, or a D50 greater than about 300 μm and a D90 less than about 850 μm, or a D50 greater than about 350 μm and less than about 700 μm.

The size distribution of the particle, as characterized according to the Granular Size Distribution Test Method, may have a D20 greater than about 150 μm and a D80 less than about 1400 μm, or a D20 greater than about 200 μm and a D80 less than about 1180 μm, or a D20 greater than about 250 μm and a D80 less than about 1000 μm.

The size distribution of the particle, as characterized according to the Granular Size Distribution Test Method, may have a D10 greater than about 150 μm and a D90 less than about 1400 μm, or a D10 greater than about 200 μm and a D90 less than about 1180 μm, or a D10 greater than about 250 μm and a D90 less than about 1000 μm.

Also, in addition to the surfactant-containing particles described above, the fibrous water-soluble unit dose articles may optionally contain other particles distributed throughout the fibrous structure. The other particles may be any solid, free-flowing particles, and may include a mixture of chemically different particles, such as phosphate particles; zeolite particles; silicate salt particles; carbonate salt particles; polymer particles; aesthetic particles; enzyme particles; bleach particles, bleach activator particles, bleach catalyst particles; filler particles; clay particles; flocculant particles; wax particles such as wax agglomerates; silicone particles, brightener particles; dye transfer inhibition particles; dye fixative particles; perfume particles; hueing dye particles; chelant particles; and any combination thereof.

Active Agents

The fibrous water-soluble unit dose articles described herein may contain one or more active agents. The active agents may be present in the fibrous elements (as described above), optionally, in particles, or, optionally, as a premix in the article. Premixes for example, may be slurries of active agents that are combined with aqueous absorbents. The active agent may be selected from the group consisting of a surfactant, a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, and mixtures thereof.

Surfactant

The surfactant may be selected from the group consisting of anionic surfactants, nonionic surfactants, cationic surfactants, zwitterionic surfactants, amphoteric surfactants, ampholytic surfactants, and mixtures thereof.

Anionic Surfactant

Suitable anionic surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

Anionic surfactants may be supplemented with salt as a means to regulate phase behavior; suitable salts may be selected from the group consisting of sodium sulfate, magnesium sulfate, sodium carbonate, sodium citrate, sodium silicate, and mixtures thereof.

Non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates. Suitable anionic surfactants may be derived from renewable resources, waste, petroleum, or mixtures thereof. Suitable anionic surfactants may be linear, partially branched, branched, or mixtures thereof.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 12 to 15 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide. In yet further examples, the alkyl ether sulfate surfactant may contain a peaked ethoxylate distribution.

Non-alkoxylated alkyl sulfates may also be added to the disclosed detergent compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^- M^+$, wherein R is typically a linear $C_8$-$C_{20}$ hydrocarbyl group, which may be straight chain or branched chain, and M is a water-solubilizing cation. In some examples, R is a $C_{10}$-$C_{18}$ alkyl, and M is an alkali metal. In other examples, R is a $C_{12}/C_{14}$ alkyl and M is sodium, such as those derived from natural alcohols.

Other useful anionic surfactants can include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS.

Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. In one aspect, a magnesium salt of LAS is used.

Another example of a suitable alkyl benzene sulfonate is a modified LAS (MLAS), which is a positional isomer that contains a branch, e.g., a methyl branch, where the aromatic ring is attached to the 2 or 3 position of the alkyl chain.

The anionic surfactant may include a 2-alkyl branched primary alkyl sulfates have 100% branching at the C2 position (C1 is the carbon atom covalently attached to the alkoxylated sulfate moiety). 2-alkyl branched alkyl sulfates and 2-alkyl branched alkylalkoxy sulfates are generally derived from 2-alkyl branched alcohols (as hydrophobes). 2-alkyl branched alcohols, e.g., 2-alkyl-1-alkanols or 2-alkyl primary alcohols, which are derived from the oxo process, are commercially available from Sasol, e.g., LIAL®, ISALCHEM® (which is prepared from LIAL® alcohols by a fractionation process). C14/C15 branched primary alkyl sulfate are also commercially available, e.g., namely LIAL® 145 sulfate.

The anionic surfactant may include a mid-chain branched anionic surfactant, e.g., a mid-chain branched anionic detersive surfactant, such as, a mid-chain branched alkyl sulphate and/or a mid-chain branched alkyl benzene sulphonate.

Additional suitable anionic surfactants include methyl ester sulfonates, paraffin sulfonates, α-olefin sulfonates, and internal olefin sulfonates.

Nonionic Surfactant

Suitable nonionic surfactants include alkoxylated fatty alcohols. The nonionic surfactant may be selected from ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15.

Other non-limiting examples of nonionic surfactants useful herein include: $C_8$-$C_{18}$ alkylethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkylalkoxylates, $BAE_x$, wherein x is from 1 to 30; alkylpolysaccharides; specifically alkylpolyglycosides; polyhydroxy fatty acid amides; and ether capped poly(oxyalkylated) alcohol surfactants.

Suitable nonionic detersive surfactants also include alkyl polyglucoside and alkylalkoxylated alcohol. Suitable nonionic surfactants also include those sold under the tradename Lutensol® from BASF.

Cationic Surfactant

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA).

Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Zwitterionic Surfactant

Suitable zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, $C_8$ to $C_{18}$ (for example from $C_{12}$ to $C_{18}$) amine oxides, and sulfo and hydroxy betaines, such as N-alkyl-N,N-dimethylammino-1-propane sulfonate where the alkyl group can be $C_8$ to $C_{18}$.

Amphoteric Surfactant

Suitable amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Suitable amphoteric surfactants also include sarcosinates, glycinates, taurinates, and mixtures thereof.

Enzymes

Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, ß-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the composition. The compositions disclosed herein may comprise from about 0.001% to about 1% by weight of an enzyme (as an adjunct), which may be selected from the group consisting of lipase, amylase, protease, mannanase, cellulase, pectinase, and mixtures thereof.

Builders

Suitable builders include aluminosilicates (e.g., zeolite builders, such as zeolite A, zeolite P, and zeolite MAP), silicates, phosphates, such as polyphosphates (e.g., sodium tri-polyphosphate), especially sodium salts thereof; carbonates, bicarbonates, sesquicarbonates, and carbonate minerals other than sodium carbonate or sesquicarbonate; organic mono-, di-, tri-, and tetracarboxylates, especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. Additional suitable builders may be selected from citric acid, lactic acid, fatty acid, polycarboxylate builders, for example, copolymers of acrylic acid, copolymers of acrylic acid and maleic acid, and copolymers of acrylic acid and/or maleic acid, and other suitable ethylenic monomers with various types of additional functionalities. Alternatively, the composition may be substantially free of builder.

Polymeric Dispersing Agents

Suitable polymeric dispersing agents include carboxymethylcellulose, poly(vinylpyrrolidone), poly (ethylene glycol), an ethylene oxide-propylene oxide-ethylene oxide ($EOx_1POyEOx_2$) triblock copolymer, where each of $x_1$ and $x_2$ is in the range of about 2 to about 140 and y is in the range of from about 15 to about 70, poly(vinyl alcohol), poly (vinylpyridine-N-oxide), poly(vinylimidazole), polycarboxylates such as polyacrylates, maleic/acrylic acid copolymers and lauryl methacrylate/acrylic acid co-polymers.

Suitable polymeric dispersing agents include amphiphilic cleaning polymers such as the compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n=from 20 to 30, and x=from 3 to 8, or sulphated or sulphonated variants thereof.

Suitable polymeric dispersing agents include amphiphilic alkoxylated grease cleaning polymers which have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkylenimines, for example, having an inner polyethylene oxide block and an outer polypropylene oxide block. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The detergent compositions described herein may comprise from about 0.1% to about 10%, and in some examples, from about 0.1% to about 8%, and in other examples, from about 0.1% to about 6%, by weight of the detergent composition, of alkoxylated polyamines.

Suitable polymeric dispersing agents include carboxylate polymer. Suitable carboxylate polymers, which may optionally be sulfonated, include a maleate/acrylate random copolymer or a poly(meth)acrylate homopolymer. In one aspect, the carboxylate polymer is a poly(meth)acrylate homopolymer having a molecular weight from 4,000 Da to 9,000 Da, or from 6,000 Da to 9,000 Da.

Suitable polymeric dispersing agents include alkoxylated polycarboxylates, which may also be used to provide grease removal. Chemically, these materials comprise poly(meth) acrylates having one ethoxy side-chain per every 7-8 (meth) acrylate units. The side-chains are of the formula —$(CH_2CH_2O)_m$ $(CH_2)_nCH_3$ wherein m is 2-3 and n is 6-12.

The side-chains are ester-linked to the polyacrylate "backbone" to provide a "comb" polymer type structure. The molecular weight can vary, but may be in the range of about 2000 to about 50,000. The detergent compositions described herein may comprise from about 0.1% to about 10%, and in some examples, from about 0.25% to about 5%, and in other examples, from about 0.3% to about 2%, by weight of the detergent composition, of alkoxylated polycarboxylates.

Suitable polymeric dispersing agents include amphiphilic graft co-polymers. A suitable amphiphilic graft co-polymer comprises (i) a polyethyelene glycol backbone; and (ii) and at least one pendant moiety selected from polyvinyl acetate, polyvinyl alcohol and mixtures thereof. A suitable amphilic graft co-polymer is Sokalan® HP22, supplied from BASF. Suitable polymers include random graft copolymers, for example, a polyvinyl acetate grafted polyethylene oxide copolymer having a polyethylene oxide backbone and multiple polyvinyl acetate side chains. The molecular weight of the polyethylene oxide backbone is typically about 6000 and the weight ratio of the polyethylene oxide to polyvinyl acetate is about 40 to 60 and no more than 1 grafting point per 50 ethylene oxide units.

Soil Release Polymer

Suitable soil release polymers have a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Cellulosic Polymer

Suitable cellulosic polymers including those selected from alkyl cellulose, alkylalkoxyalkyl cellulose, carboxyalkyl cellulose, alkyl carboxyalkyl cellulose. The cellulosic polymers may be selected from the group consisting of carboxymethyl cellulose, methyl cellulose, methyl hydroxyethyl cellulose, methyl carboxymethyl cellulose, and mixtures thereof. In one aspect, the carboxymethyl cellulose has a degree of carboxymethyl substitution from 0.5 to 0.9 and a molecular weight from 100,000 Da to 300,000 Da.

Amines

Non-limiting examples of amines may include, but are not limited to, polyetheramines, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof.

Bleaching Agents

Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent compositions of the present invention may comprise from about 0.1% to about 50% or even from about 0.1% to about 25% bleaching agent by weight of the detergent composition.

Bleach Catalysts

Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Brighteners

Commercial fluorescent brighteners suitable for the present disclosure can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents.

The fluorescent brightener may be selected from the group consisting of disodium 4,4'-bis{[4-anilino-6-morpholino-s-triazin-2-yl]-amino}-2,2'-stilbenedisulfonate (brightener 15, commercially available under the tradename Tinopal AMS-GX by BASF), disodium4,4'-bis{[4-anilino-6-(N-2-bis-hydroxyethyl)-s-triazine-2-yl]-amino}-2,2'-stilbenedisulonate (commercially available under the tradename Tinopal UNPA-GX by BASF), disodium 4,4'-bis{[4-anilino-6-(N-2-hydroxyethyl-N-methylamino)-s-triazine-2-yl]-amino}-2,2'-stilbenedisulfonate (commercially available under the tradename Tinopal SBM-GX by BASF). The fluorescent brightener may be disodium 4,4'-bis{[4-anilino-6-morpholino-s-triazin-2-yl]-amino}-2,2'-stilbenedisulfonate.

The brighteners may be added in particulate form or as a premix with a suitable solvent, for example nonionic surfactant, propanediol.

Fabric Hueing Agents

A fabric hueing agent (sometimes referred to as shading, bluing or whitening agents) typically provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes also include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Suitable polymeric dyes also include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. Suitable polymeric dyes also include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

The aforementioned fabric hueing agents can be used in combination (any mixture of fabric hueing agents can be used).

Encapsulates

An encapsulate may comprise a core, a shell having an inner and outer surface, said shell encapsulating said core. The core may comprise any laundry care adjunct, though typically the core may comprise material selected from the group consisting of perfumes; brighteners; hueing dyes; insect repellants; silicones; waxes; flavors; vitamins; fabric softening agents; skin care agents in one aspect, paraffins; enzymes; anti-bacterial agents; bleaches; sensates; and mixtures thereof; and said shell may comprise a material selected from the group consisting of polyethylenes; polyamides; polyvinylalcohols, optionally containing other co-monomers; polystyrenes; polyisoprenes; polycarbonates; polyesters; polyacrylates; aminoplasts, in one aspect said aminoplast may comprise a polyureas, polyurethane, and/or polyureaurethane, in one aspect said polyurea may comprise polyoxymethyleneurea and/or melamine formaldehyde; polyolefins; polysaccharides, in one aspect said polysaccharide may comprise alginate and/or chitosan; gelatin; shellac; epoxy resins; vinyl polymers; water insoluble inorganics; silicone; and mixtures thereof.

Preferred encapsulates comprise perfume. Preferred encapsulates comprise a shell which may comprise melamine formaldehyde and/or cross linked melamine formaldehyde. Other preferred capsules comprise a polyacrylate based shell. Preferred encapsulates comprise a core material and a shell, said shell at least partially surrounding said core material, is disclosed. At least 75%, 85% or even 90% of said encapsulates may have a fracture strength of from 0.2 MPa to 10 MPa, and a benefit agent leakage of from 0% to 20%, or even less than 10% or 5% based on total initial encapsulated benefit agent. Preferred are those in which at least 75%, 85% or even 90% of said encapsulates may have (i) a particle size of from 1 microns to 80 microns, 5 microns to 60 microns, from 10 microns to 50 microns, or even from 15 microns to 40 microns, and/or (ii) at least 75%, 85% or even 90% of said encapsulates may have a particle wall thickness of from 30 nm to 250 nm, from 80 nm to 180 nm, or even from 100 nm to 160 nm. Formaldehyde scavengers may be employed with the encapsulates, for example, in a capsule slurry and/or added to a composition before, during or after the encapsulates are added to such composition.

Suitable capsules that can be made using known processes. Alternatively, suitable capsules can be purchased from Encapsys LLC of Appleton, Wis. USA. The composition may comprise a deposition aid, for example, in addition to encapsulates. Preferred deposition aids are selected from the group consisting of cationic and nonionic polymers. Suitable polymers include cationic starches, cationic hydroxyethylcellulose, polyvinylformaldehyde, locust bean gum, mannans, xyloglucans, tamarind gum, polyethyleneterephthalate and polymers containing dimethylaminoethyl methacrylate, optionally with one or more monomers selected from the group comprising acrylic acid and acrylamide.

Perfumes

Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the detergent composition.

Dye Transfer Inhibiting Agents

Dye transfer inhibiting agents are effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.0001% to about 10%, by weight of the composition, in some examples, from about 0.01% to about 5%, by weight of the composition, and in other examples, from about 0.05% to about 2% by weight of the composition.

Chelating Agents

Suitable chelating agents include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof. Other suitable chelating agents for use herein are the commercial DEQUEST series, and chelants from Monsanto, Akzo-Nobel, DuPont, Dow, the Trilon® series from BASF and Nalco.

Suds Suppressors

Compounds for reducing or suppressing the formation of suds can be incorporated into the water-soluble unit dose articles. Suds suppression can be of particular importance in the so-called "high concentration cleaning process" and in front-loading style washing machines. Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons having a melting point below about 100° C., silicone suds suppressors, and secondary alcohols.

Additional suitable antifoams are those derived from phenylpropylmethyl substituted polysiloxanes.

The detergent composition may comprise a suds suppressor selected from organomodified silicone polymers with aryl or alkylaryl substituents combined with silicone resin and a primary filler, which is modified silica. The detergent compositions may comprise from about 0.001% to about 4.0%, by weight of the composition, of such a suds suppressor.

The detergent composition comprises a suds suppressor selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the anti-foam.

Suds Boosters

If high sudsing is desired, suds boosters such as the $C_{10}$-$C_{16}$ alkanolamides may be used. Some examples include the $C_{10}$-$C_{14}$ monoethanol and diethanol amides. If desired, water-soluble magnesium and/or calcium salts such as $MgCl_2$, $MgSO_4$, $CaCl_2$), $CaSO_4$, and the like, may be added at levels of about 0.1% to about 2% by weight of the detergent composition, to provide additional suds and to enhance grease removal performance Conditioning Agents Suitable conditioning agents include high melting point fatty compounds. The high melting point fatty compound useful herein has a melting point of 25° C. or higher, and is selected from the group consisting of fatty alcohols, fatty acids, fatty alcohol derivatives, fatty acid derivatives, and mixtures thereof. Suitable conditioning agents also include nonionic polymers and conditioning oils, such as hydrocarbon oils, polyolefins, and fatty esters.

Suitable conditioning agents include those conditioning agents characterized generally as silicones (e.g., silicone oils, polyoils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein.

Fabric Enhancement Polymers

Suitable fabric enhancement polymers are typically cationically charged and/or have a high molecular weight. The fabric enhancement polymers may be a homopolymer or be formed from two or more types of monomers. The monomer weight of the polymer will generally be between 5,000 and 10,000,000, typically at least 10,000 and preferably in the range 100,000 to 2,000,000. Preferred fabric enhancement polymers will have cationic charge densities of at least 0.2 meq/gm, preferably at least 0.25 meq/gm, more preferably at least 0.3 meq/gm, but also preferably less than 5 meq/gm, more preferably less than 3 meq/gm, and most preferably less than 2 meq/gm at the pH of intended use of the composition, which pH will generally range from pH 3 to pH 9, preferably between pH 4 and pH 8. The fabric enhancement polymers may be of natural or synthetic origin.

Pearlescent Agent

Non-limiting examples of pearlescent agents include: mica; titanium dioxide coated mica; bismuth oxychloride; fish scales; mono and diesters of alkylene glycol. The pearlescent agent may be ethyleneglycoldistearate (EGDS).

Hygiene and Malodour

Suitable hygiene and malodor active agents include zinc ricinoleate, thymol, quaternary ammonium salts such as Bardac®, polyethylenimines (such as Lupasol® from BASF) and zinc complexes thereof, silver and silver compounds, especially those designed to slowly release $Ag^+$ or nano-silver dispersions.

Buffer System

The water-soluble unit dose articles described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, lactic acid or lactate, monoethanol amine or other amines, boric acid or borates, and other pH-adjusting compounds well known in the art.

The detergent compositions herein may comprise dynamic in-wash pH profiles. Such detergent compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Method for Making

Figure 4:
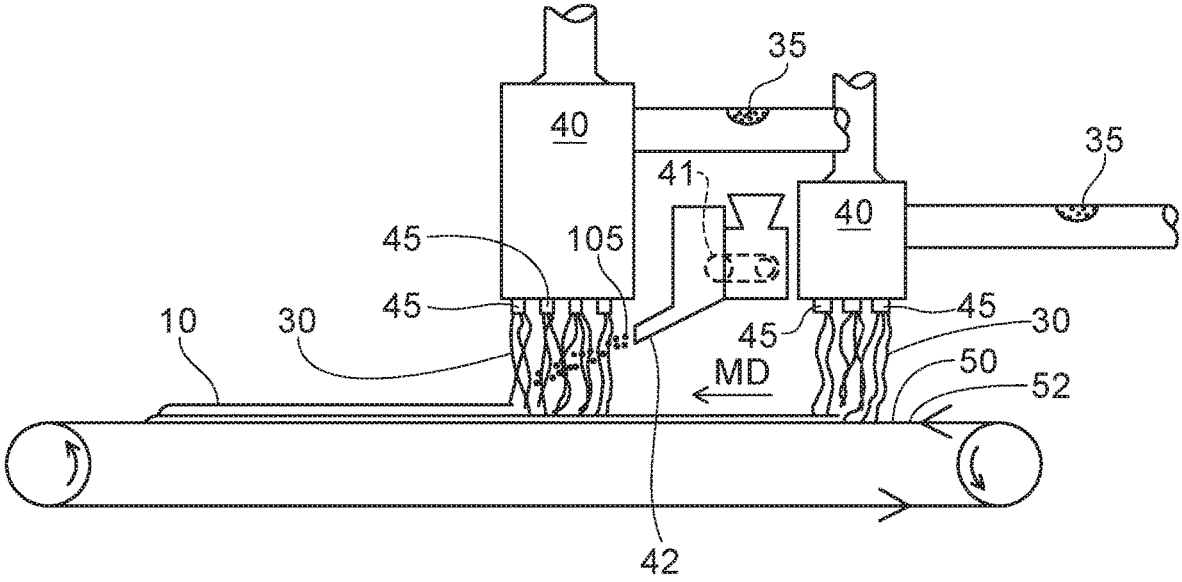
FIG. 4 is a process for making one or more plies of fibrous water-soluble unit dose article.
Figure 5:
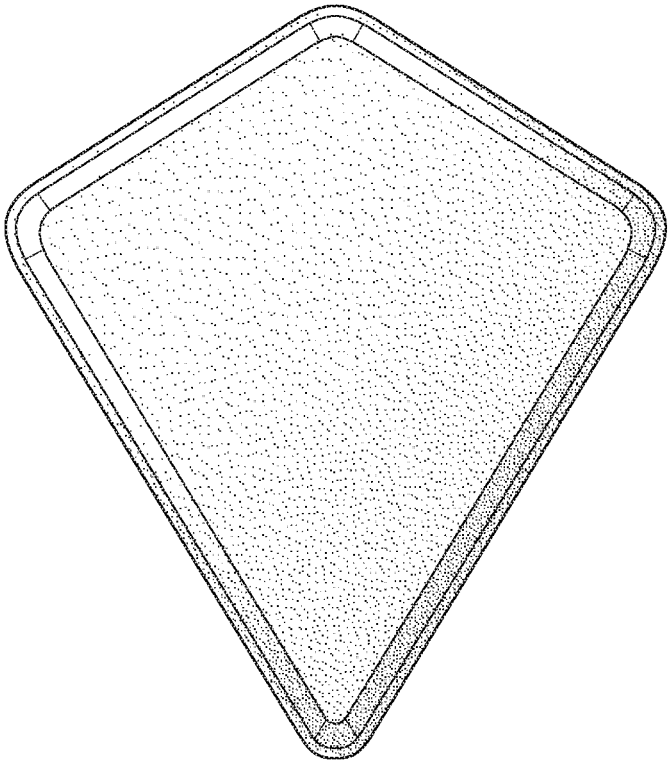
FIG. 5 is a front view of a unit dose article having a kite shape.
Figure 6:
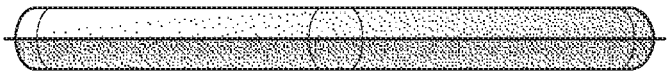
FIG. 6 is a top view of a unit dose article having a kite shape.
Figure 7:
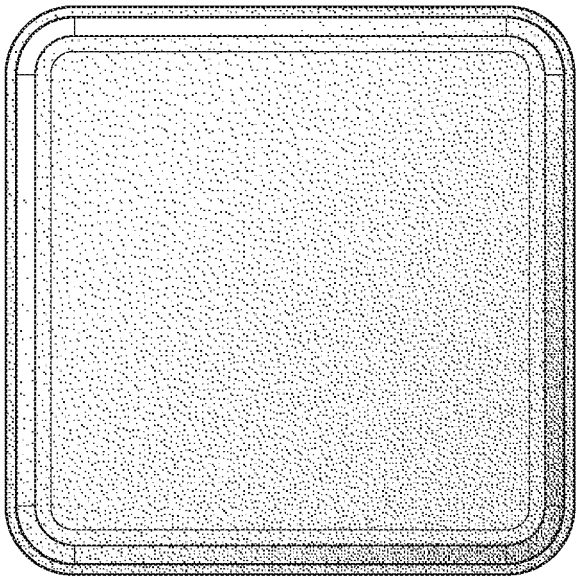
FIG. 7 is a front view of a unit dose article having a square shape.
Figure 8:
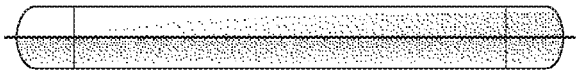
FIG. 8 is a top view of a unit dose article having a square shape.

As exemplified by illustration in FIG. 4, a solution of a filament forming composition 35 is provided. The filament forming composition can comprise one or more filament forming materials and optionally one or more active agents. The filament forming composition 35 is passed through one or more die block assemblies 40 comprising a plurality of spinnerets 45 to form a plurality of fibrous elements 30 comprising the one or more filament forming materials and optionally one or more active agents. Multiple die block assemblies 40 can be employed to spin different layers of fibrous elements 30, with the fibrous elements 30 of different layers having a composition that differ from one another or are the same as one another. More than two die block assemblies in series can be provided to form three, four, or any other integer number of layers in a given ply. The fibrous elements 30 can be deposited on a belt 50 moving in a machine direction MD to form a first ply 10.

Optionally, particles can be introduced into the stream of the fibrous elements 30 between the die block assembly 40 and the belt 50. Particles can be fed from a particle receiver onto a belt feeder 41 or optionally a screw feeder. The belt feeder 41 can be set and controlled to deliver the desired mass of particles into the process. The belt feeder can feed an air knife 42 that suspends and directs the particles in an air stream into the fibrous elements 30 to form a particle-fiber layer of comingled fibrous elements 30 and particles that is subsequently deposited on the belt 50.

To form the water-soluble product, a first ply 10 can be provided. A second ply 15 can be provided separate from the first ply 10. The first ply 10 and the second ply 15 are superposed with one another. By superposed it is meant that one is positioned above or below the other with the proviso that additional plies or other materials, for example active agents, may be positioned between the superposed plies. A portion of the first ply 10 can be joined to a portion of the second ply 15 to form the water-soluble product 5. Each ply may comprise one or more layers.

Method of Laundering

The present invention also encompasses a method of laundering using an article according to the present invention, comprising the steps of, placing at least one article according to the present invention into the washing machine along with the laundry to be washed, and carrying out a washing or cleaning operation.

Any suitable washing machine may be used. Those skilled in the art will recognize suitable machines for the relevant wash operation. The article of the present invention may be used in combination with other compositions, such as fabric additives, fabric softeners, rinse aids and the like.

The wash temperature may be 30° C. or less. The wash process may comprise at least one wash cycle having a duration of between 5 and 20 minutes. The automatic laundry machine may comprise a rotating drum, and wherein during at least one wash cycle, the drum has a rotational speed of between 15 and 40 rpm, preferably between 20 and 35 rpm.

Specific contemplated aspects of the disclosure are herein described in the following numbered paragraphs.

1. A container system comprising: a flat package having walls that define an interior space; at least one fibrous water-soluble unit dose article in the interior space, the fibrous water-soluble unit dose article comprising household care active agents.
2. The container system according to paragraph 1, wherein the package is flexible.
3. The container system according to any one of the preceding paragraphs, wherein the package has a height of no more than about 0.75 inches (1.905 cm).
4. The container system according to any one of the preceding paragraphs wherein the package has a height of no less than about 0.25 inches (0.635 cm).
5. The container system according to any one of the preceding paragraphs wherein the fibrous water-soluble unit dose articles are stacked in a two- or three-dimensional array, preferably a three-dimensional array.
6. The container system according to any one of the preceding paragraphs wherein the package has a length of no more than about 15 inches (38.1 cm) and a width of no more than about 12 inches (30.48 cm).
7. The container system according to any one of the preceding paragraphs wherein the package has a length of no less than about 11.5 inches (29.21 cm) and a width of no less than about 6.125 inches (15.5575 cm).
8. The container system according to any one of the preceding paragraphs wherein the shape of the fibrous water-soluble unit dose articles is selected from the group consisting of a square, a kite, a rectangle, a triangle, a circle, an ellipse, and mixtures thereof.
9. The container system according to any one of the preceding paragraphs wherein the shape of the fibrous water-soluble unit dose articles is a square, preferably a rounded square.
10. The container system according to any one of the preceding paragraphs wherein the fibrous water-soluble unit dose articles comprise a water-soluble fibrous structure comprising fibrous elements.
11. The container system according to paragraph 10 wherein at least one of said fibrous elements comprises from about 5% to about 90% by weight, preferably from about 20% to about 80% by weight, more preferably from about 30% to about 70% by weight on a dry fibrous element basis of total household care active agents.
12. The container system according to paragraph 11 wherein at least one of said fibrous elements comprises a household care active agent selected from the group consisting of a surfactant, a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, mosquito repellant, and mixtures thereof.
13. The container system according to paragraph 12 wherein at least one of said fibrous elements comprises a surfactant, preferably an anionic surfactant, more preferably an anionic surfactant selected from the group consisting of unalkoxylated C6-C20 linear or branched alkyl sulfates (AS), C6-C20 linear alkylbenzene sulfonates (LAS), and combinations thereof, preferably C6-C20 linear alkylbenzene sulfonates (LAS).
14. The container system according to any one of the preceding paragraphs wherein at least one of the fibrous water-soluble unit dose articles further comprises a plurality of particles.
15. The container system according to paragraph 14 wherein at least one of said particles comprises a household care active agent selected from the group consisting of a surfactant, a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, a mosquito repellant, and mixtures thereof.
16. The container system according to paragraph 15 wherein at least one of said particles comprises a surfactant, preferably an anionic surfactant, more preferably an anionic surfactant selected from the group consisting of C6-C20 linear or branched alkylalkoxylated sulfates (AAS) having a weight average degree of alkoxylation ranging from 0.1 to 10, C6-C20 alkylalkoxylated alcohols (AA) having a weight average degree of alkoxylation ranging from 5 to 15, and combinations thereof.
17. The container system according to paragraph 10 wherein at least one of said fibrous elements comprises a filament-forming material, preferably the filament-forming material is selected from the group consisting of pullulan, hydroxypropylmethyl cellulose, hydroxyethyl cellulose, hydroxypropyl cellulose, polyvinyl pyrrolidone, carboxymethyl cellulose, sodium alginate, xanthan gum, tragacanth gum, guar gum, acacia gum, Arabic gum, polyacrylic acid, methylmethacrylate copolymer, carboxyvinyl polymer, dextrin, pectin, chitin, levan, elsinan, collagen, gelatin, zein, gluten, soy protein, casein, polyvinyl alcohol, carboxylated polyvinyl alcohol, sulfonated polyvinyl alcohol, polyethylene glycol, starch, starch derivatives, hemicellulose, hemicellulose derivatives, proteins, chitosan, chitosan derivatives, polyethylene glycol, tetramethylene ether glycol, hydroxymethyl cellulose, and mixtures thereof, more preferably the filament-forming material is selected from the group consisting of carboxymethyl cellulose, polyvinyl alcohol, and mixtures thereof.
18. The container system according to any one of the preceding paragraphs wherein the fibrous water-soluble unit dose article has a width from about 1 cm to about 11 cm; a length from about 1 cm to about 20 cm; a height from about 0.01 mm to about 50 mm
19. The container system according to any one of the preceding paragraphs wherein the fibrous water-soluble unit dose articles are tessellated.

20. The container system of any one of the preceding paragraphs wherein the package is the primary package (the package that the product touches).
21. The container system of any one of the preceding paragraphs wherein the package is the secondary package (helps with transit).
22. A container system according to any one of the preceding paragraphs wherein the fibrous water-soluble unit dose articles are in a fixed position.
23. A method of shipping unit dose articles comprising household care active agents directly from the manufacturer to the consumer, wherein the unit dose articles are contained in a flat package having a length of at most 20 inches (50.8 cm), a width of at most 15 inches (38.1 cm), and a height of at most 1.5 inches (3.81 cm), preferably the unit dose articles are shipped to the consumer by a mail service.
24. The method of paragraph 23 wherein the unit dose articles are contained in a flat package having a length of at most 17 inches (43.18 cm), a width of at most 13 inches (33.02 cm), and a height of at most 1.5 inches (3.81 cm).
25. The method of paragraph 23 wherein the unit dose articles are contained in a flat package having a length of at least 15 inches (38.1 cm), a width of at least 12 inches (30.48), and a height of at least 1.5 inches (3.81 cm).
26. The method of paragraph 23 wherein the flat package has a weight ranging from about 0.1 pounds (45.3592 g) to about 5 pounds (2.26796 kg).

Test Methods

Thickness Test Methods

Fibrous Water-Soluble Articles

Thickness of a fibrous structure is measured by cutting 5 samples of a fibrous structure sample such that each cut sample is larger in size than a load foot loading surface of a VIR Electronic Thickness Tester Model II available from Thwing-Albert Instrument Company, Philadelphia, Pa. Typically, the load foot loading surface has a circular surface area of about 3.14 in2. The sample is confined between a horizontal flat surface and the load foot loading surface. The load foot loading surface applies a confining pressure to the sample of 15.5 g/cm2. The thickness of each sample is the resulting gap between the flat surface and the load foot loading surface. The thickness is calculated as the average thickness of the five samples. The result is reported in millimeters (mm).

Flat Package

When measuring the thickness of a flat package, the outside edges are excluded, when the contents do not extend into those edges. The thickness is measured at least 1 inch (2.54 cm) from each edge, when the contents do not extend into those edges.

Minimum Flexibility for Flat Packages:

A flat package is placed with the length parallel to the edge of a flat surface, such as a table, and the flat package is extended halfway off (if the package is assymetrical, the center of gravity can be used to determine halfway) the surface, as shown in FIG. 1. Steady force is applied to the package at a point 1 inch (2.54 cm) from the outer edge, in the center of the package's length. The amount of force varies based on the package. Generally, sufficient force is applied to bend the package 1 inch (2.54 cm) vertically. Typical forces range from 2 N to 10 N. A package is flexible if it can bend at least 1 inch (2.54 cm) vertically without being damaged.

Maximum Deflection for Flat Packages

Figure 2:
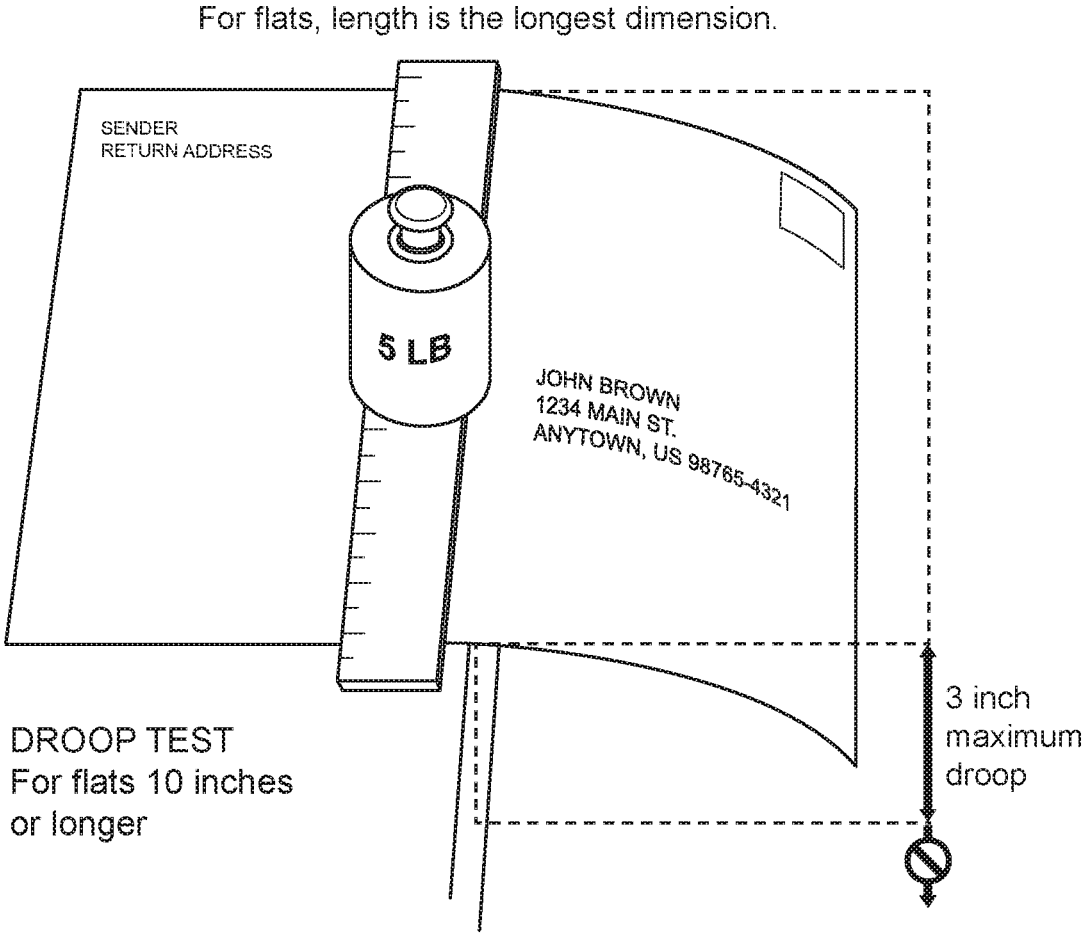
FIG. 2 demonstrates the maximum deflection or droop test for a flat package that is 10 inches (25.4 cm) or longer.

For flat packages that are 10 inches (25.4 cm) or greater in length (see FIG. 2), the package is placed on a flat, straight-edge surface, such as a rectangular table, with the length perpendicular to the edge of the surface and the package is extended 5 inches (12.7 cm) off the edge of the surface. For square-shaped bound flats, the bound edge is placed parallel to the edge of the surface. A flat 12-inch ruler (or other similar flat object 12 inches (30.48 cm) or longer) is placed on top of the package with the length of the ruler parallel to the edge of the surface and as close to the edge as possible. A certified 5-pound weight is placed on the center of the ruler to hold the package in place; the 5-pound weight is placed such that it does not extend past the edge. The vertical deflection or droop is measured, the packaged is turned around 180 degrees, and the vertical deflection or droop is measured again.

Figure 3:
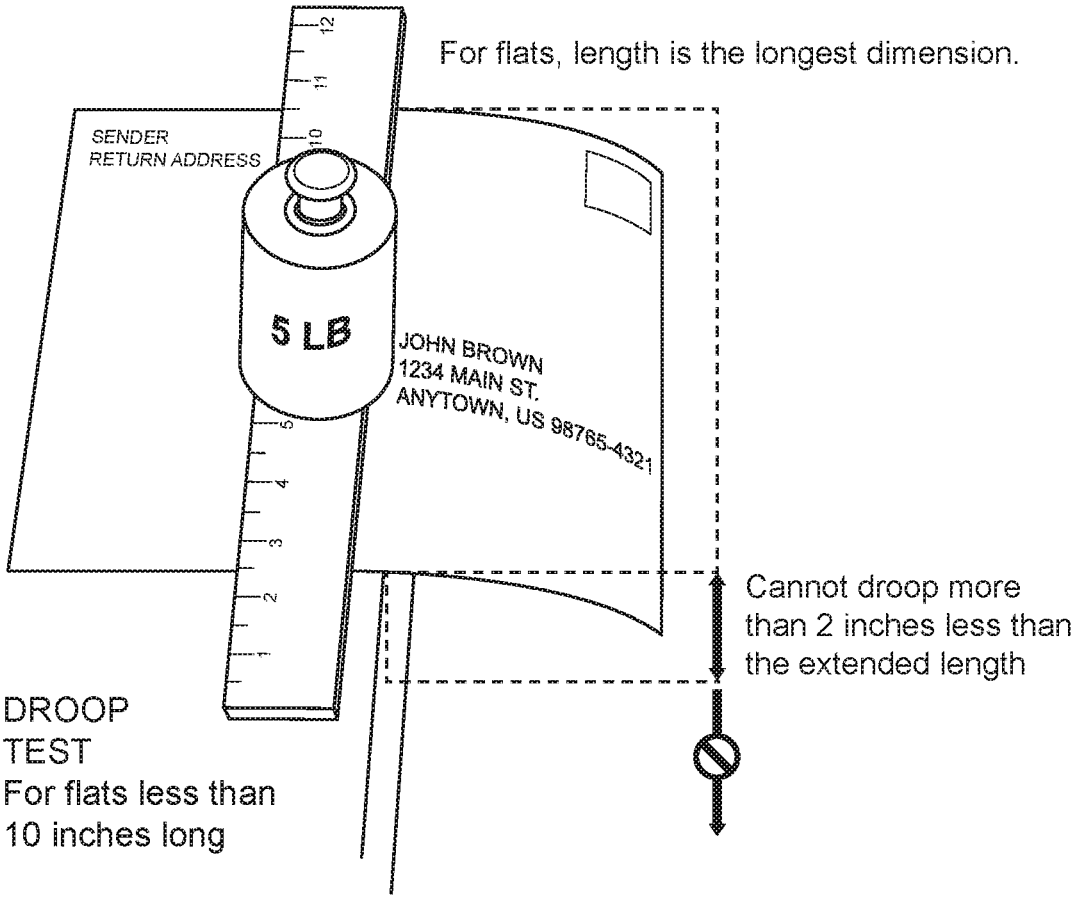
FIG. 3 demonstrates the maximum deflection or droop test for a flat package that is less than 10 inches (25.4 cm) long.

For flat packages that are less than 10 inches (25.4 cm) in length (see FIG. 3), the package is placed on a flat, straight-edge surface with the length perpendicular to the edge of the surface and the package is extended one-half of its length off the edge of the surface. For square-shaped bound flats, the bound edge is placed parallel to the edge of the surface. A flat 12-inch ruler (or other similar flat object 12 inches (30.48 cm) or longer) is placed on top of the package with the length of the ruler parallel to the edge of the surface and as close to the edge as possible. A certified 5-pound weight is placed on the center of the ruler to hold the package in place; the 5-pound weight is placed such that it does not extend past the edge. The vertical deflection or droop is measured, the packaged is turned around 180 degrees, and the vertical deflection or droop is measured again.

Basis Weight Test Method

Basis weight of a fibrous structure is measured on stacks of twelve usable units using a top loading analytical balance with a resolution of ±0.001 g. The balance is protected from air drafts and other disturbances using a draft shield. A precision cutting die, measuring 3.500 in ±0.0035 in by 3.500 in ±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

$$\text{Basis Weight}=(\text{Mass of stack})/[(\text{Area of 1 square in stack})\times(\text{No. of squares in stack})]$$

For example, $$\text{Basis Weight (lbs/3000 ft}^2)=[[\text{Mass of stack (g)}/453.6\ (\text{g/lbs})]/[12.25\ (\text{in}^2)/144\ (\text{in}^2/\text{ft}^2)\times 121]]\times 3000$$

or, $$\text{Basis Weight (g/m}^2)=\text{Mass of stack (g)}/[79.032\ (\text{cm}^2)/10{,}000\ (\text{cm}^2/\text{m}^2)\times 12]$$

Report result to the nearest 0.1 lbs/3000 $ft^2$ or 0.1 $g/m^2$. Sample dimensions can be changed or varied using a similar precision cutter as mentioned above, so as at least 100 square inches (254 square cm) of sample area in stack.

Granular Size Distribution Test Method

The granular size distribution test is conducted to determine characteristic sizes of particles. It is conducted using ASTM D 502-89, "Standard Test Method for Particle Size of Soaps and Other Detergents", approved May 26, 1989, with a further specification for sieve sizes and sieve time used in the analysis. Following section 7, "Procedure using machine-sieving method," a nest of clean dry sieves containing U.S. Standard (ASTM E 11) sieves #4 (4.75 mm), #6 (3.35 mm), #8 (2.36 mm), #12 (1.7 mm), #16 (1.18 mm), #20 (850 μm), #30 (600 μm), #40 (425 μm), #50 (300 μm), #70 (212 μm), #100 (150 μm) is required to cover the range of particle sizes referenced herein. The prescribed Machine-Sieving Method is used with the above sieve nest. A suitable sieve-shaking machine can be obtained from W.S. Tyler Company, Ohio, U.S.A. The sieve-shaking test sample is approximately 100 grams and is shaken for 5 minutes.

The data are plotted on a semi-log plot with the micron size opening of each sieve plotted against the logarithmic abscissa and the cumulative mass percent ($Q_3$) plotted against the linear ordinate. An example of the above data representation is given in ISO 9276-1:1998, "Representation of results of particle size analysis—Part 1: Graphical Representation", Figure A.4. A characteristic particle size (Dx), for the purpose of this invention, is defined as the abscissa value at the point where the cumulative mass percent is equal to x percent, and is calculated by a straight line interpolation between the data points directly above (a) and below (b) the x % value using the following equation:

$$Dx=10\hat{}[\mathrm{Log}(Da)-(\mathrm{Log}(Da)-\mathrm{Log}(Db))*(Qa-x\%)/(Qa-Qb)]$$

where Log is the base-10 logarithm, Qa and Qb are the cumulative mass percentile values of the measured data immediately above and below the $x^{th}$ percentile, respectively; and Da and Db are the micron sieve size values corresponding to these data.

Example Data and Calculations:

| sieve size (um) | weight on sieve (g) | cumulative mass % finer (CMPF) |
|---|---|---|
| 4750 | 0 | 100% |
| 3350 | 0 | 100% |
| 2360 | 0 | 100% |
| 1700 | 0 | 100% |
| 1180 | 0.68 | 99.3% |
| 850 | 10.40 | 89.0% |
| 600 | 28.73 | 60.3% |
| 425 | 27.97 | 32.4% |
| 300 | 17.20 | 15.2% |
| 212 | 8.42 | 6.8% |
| 150 | 4.00 | 2.8% |
| pan | 2.84 | 0.0% |

For D10 (x=10%), the micron screen size where CMPF is immediately above 10% (Da) is 300 μm, the screen below (Db) is 212 μm. The cumulative mass immediately above 10% (Qa) is 15.2%, below (Qb) is 6.8%.

$$D10=10\hat{}[\mathrm{Log}(300)-(\mathrm{Log}(300)-\mathrm{Log}(212))*(15.2\%-10\%)/(15.2\%-6.8\%)]=242\ \mu m$$

For D50 (x=50%), the micron screen size where CMPF is immediately above 50% (Da) is 1180 μm, the screen below (Db) is 850 μm. The cumulative mass immediately above 90% (Qa) is 99.3%, below (Qb) is 89.0%.

$$D50=10\hat{}[\mathrm{Log}(600)-(\mathrm{Log}(600)-\mathrm{Log}(425))*(60.3\%-50\%)/(60.3\%-32.4\%)]=528\ \mu m$$

For D90 (x=90%), the micron screen size where CMPF is immediately above 90% (Da) is 600 μm, the screen below (Db) is 425 μm. The cumulative mass immediately above 50% (Qa) is 60.3%, below (Qb) is 32.4%.

$$D90=10\hat{}[\mathrm{Log}(1180)-(\mathrm{Log}(1180)-\mathrm{Log}(850))*(99.3\%-90\%)/(99.3\%-89.0\%)]=878\ \mu m$$

Diameter Test Method

The diameter of a discrete fibrous element or a fibrous element within a fibrous structure is determined by using a Scanning Electron Microscope (SEM) or an Optical Microscope and an image analysis software. A magnification of 200 to 10,000 times is chosen such that the fibrous elements are suitably enlarged for measurement. When using the SEM, the samples are sputtered with gold or a palladium compound to avoid electric charging and vibrations of the fibrous element in the electron beam. A manual procedure for determining the fibrous element diameters is used from the image (on monitor screen) taken with the SEM or the optical microscope. Using a mouse and a cursor tool, the edge of a randomly selected fibrous element is sought and then measured across its width (i.e., perpendicular to fibrous element direction at that point) to the other edge of the fibrous element. A scaled and calibrated image analysis tool provides the scaling to get actual reading in μm. For fibrous elements within a fibrous structure, several fibrous element are randomly selected across the sample of the fibrous structure using the SEM or the optical microscope. At least two portions of the fibrous structure are cut and tested in this manner. Altogether at least 100 such measurements are made and then all data are recorded for statistical analysis. The recorded data are used to calculate average (mean) of the fibrous element diameters, standard deviation of the fibrous element diameters, and median of the fibrous element diameters.

Another useful statistic is the calculation of the amount of the population of fibrous elements that is below a certain upper limit. To determine this statistic, the software is programmed to count how many results of the fibrous element diameters are below an upper limit and that count (divided by total number of data and multiplied by 100%) is reported in percent as percent below the upper limit, such as percent below 1 micrometer diameter or %-submicron, for example. We denote the measured diameter (in μm) of an individual circular fibrous element as di.

In the case that the fibrous elements have non-circular cross-sections, the measurement of the fibrous element diameter is determined as and set equal to the hydraulic diameter which is four times the cross-sectional area of the fibrous element divided by the perimeter of the cross-section of the fibrous element (outer perimeter in case of hollow fibrous elements). The number-average diameter, alternatively average diameter is calculated as:

$$d_{num}=\frac{\sum_{i=1}^{n} d_i}{n}$$

Water Content Test Method

The water (moisture) content present in a particle and/or substrate structure is measured using the following Water Content Test Method. A particle or portion thereof ("sample") in the form of a pre-cut sheet is placed in a conditioned room at a temperature of 23° C.±1.0° C. and a relative humidity of 50%±2% for at least 24 hours prior to testing. Each structure sample has an area of at least 4 square inches (10.16 square cm), but small enough in size to fit appropriately on the balance weighing plate. Under the temperature and humidity conditions mentioned above, using a balance with at least four decimal places, the weight of the sample is recorded every five minutes until a change of less than 0.5% of previous weight is detected during a 10-minute period. The final weight is recorded as the "equilibrium weight". Within 10 minutes, the samples are placed into the forced air oven on top of foil for 24 hours at 70° C.±2° C. at a relative humidity of 4%±2% for drying. After the 24 hours of drying, the sample is removed and weighed within 15 seconds. This weight is designated as the "dry weight" of the sample.

The water (moisture) content of the sample is calculated as follows:

$$\%\ \text{Water in sample} = 100\% \times \frac{(\text{Equilibrium weight of sample} - \text{Dry weight of sample})}{\text{Dry weight of sample}}$$

The % Water (moisture) in sample for 3 replicates is averaged to give the reported % Water (moisture) in sample. Report results to the nearest 0.1%.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising:

a flat primary package having walls that define an interior space;

a sheet comprising a first set of multiple fibrous water-soluble unit dose articles, the sheet being surrounded by the interior space, the first set of fibrous water-soluble unit dose articles comprising a first ply comprising a plurality of particles distributed therein, wherein the plurality of particles comprise one or more household care active agents, a second ply comprising a printed area, wherein the printed area covers between about 10% and about 100% of an outer surface of the fibrous water-soluble unit dose article, a third ply comprising a second plurality of particles distributed therein, wherein the second plurality of particles comprise one or more household care active agents, wherein the first ply and the third ply define a pocket therebetween; and a third plurality of particles disposed within the pocket, wherein the third plurality of particles comprise one or more household care active agents, and wherein the fibrous water-soluble unit dose articles are detachably connected to one another.

2. The container system of claim 1, wherein the flat package is flexible.

3. The container system according to claim 1, wherein the package has a height of no more than about 0.75 inches (1.905 cm).

4. The container system according to claim 1, wherein the package has a height of no less than about 0.25 inches (.635 cm).

5. The container system according to claim 1, wherein the package has a length of no more than about 15 inches (38.1 cm) and a width of no more than about 12 inches (30.48 cm).

6. The container system according to claim 1, wherein the package has a length of no less than about 11.5 inches (29.21 cm) and a width of no less than about 6.125 inches (15.5575 cm).

7. The container system according to claim 1, wherein the shape of the fibrous water-soluble unit dose articles is selected from the group consisting of a square, a kite, a rounded square, a rectangle, a triangle, a circle, an ellipse, and mixtures thereof.

8. The container system according to claim 1, wherein the fibrous water-soluble unit dose articles comprise a water-soluble fibrous structure comprising fibrous elements.

9. The container system according to claim 8 wherein, at least one of said fibrous elements comprises from about 5% to about 90% by weight, on a dry fibrous element basis of total household care active agents.

10. The container system according to claim 1, wherein the household care active agent is selected from the group consisting of a surfactant, a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, mosquito repellant, and mixtures thereof.

11. The container system according to claim 1, wherein at least one of the fibrous water-soluble unit dose articles further comprises a plurality of particles comprising a household care active agent selected from the group consisting of a surfactant, a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, a mosquito repellant, and mixtures thereof.

12. The container system according to according to claim 1, wherein the fibrous water-soluble unit dose articles are tessellated.

13. The container system of claim 1, further comprising a second set of multiple fibrous water-soluble unit dose articles detachably connected to one another and stacked on the first set of multiple fibrous water-soluble unit dose articles.

14. The container system of claim 1, wherein the flat package is a mailer.

15. The container system according to claim 1, wherein the first set of fibrous water-soluble unit dose articles comprises fibrous water-soluble unit dose articles of different sizes.

16. The container system according to claim 1, wherein the first set of fibrous water-soluble unit dose articles comprises a first fibrous water-soluble unit dose article and a second fibrous water-soluble unit dose article, wherein the first article and the second article have different compositions.

* * * * *